US006638099B2

(12) United States Patent
Nakamura

(10) Patent No.: US 6,638,099 B2
(45) Date of Patent: Oct. 28, 2003

(54) CONNECTOR

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/370,189

(22) Filed: Feb. 19, 2003

(65) Prior Publication Data

US 2003/0157828 A1 Aug. 21, 2003

(51) Int. Cl.[7] ..... H01R 3/00
(52) U.S. Cl. ..... 439/489; 439/544; 439/557
(58) Field of Search ..... 439/488, 489, 439/544, 549, 552, 557, 157

(56) References Cited

U.S. PATENT DOCUMENTS 5,226,834 A * 7/1993 Kato et al. ..... 439/489
5,621,328 A * 4/1997 Yamanashi ..... 439/488
5,779,500 A 7/1998 Tokuwa et al.
5,791,935 A * 8/1998 Yamanashi ..... 439/489
6,033,241 A * 3/2000 Iwata et al. ..... 439/489

* cited by examiner

*Primary Examiner*—Tho D. Ta
(74) *Attorney, Agent, or Firm*—Anthony J. Casella; Gerald E. Hespos

(57) ABSTRACT

A housing (20) is mountable to a mount hole (H) in a panel (P) and then is connectable with a mating housing (10). The housing (20) has a detector (50) that is movable between a standby position and a mount detecting position. Movement of the detector (50) to the mount detecting position is prevented by interference with the inner surface of the mount hole (H) while the housing (20) is being mounted on the panel (P). However the detector (50) can move to the mount detecting position when the housing (20) is mounted properly. Movement of the detector (50) from the mount detecting position to the standby position is prevented by interference with a rib (18) of the mating housing (10) while the housings (10, 20) are being connected. However, the detector (50) can move to the standby position when the housings (10, 20) are connected properly.

17 Claims, 29 Drawing Sheets

CONNECTOR

BACKGROUND OF THE INVENTION

1. Field of the Invention

The invention relates to a connector that is mountable on a panel.

2. Description of the Related Art

U.S. Pat. No. 5,779,500 and FIG. 29 herein show a connector that is mountable on a door panel of an automotive vehicle. As shown in FIG. 29, the connector has a housing 1 with a flange 2 and a lock 3. The lock 3 passes through a mount hole H in a panel P and engages a first surface of the panel P. Simultaneously, the flange 2 engages the second surface of the panel P. Thus, the panel P is held between the lock 3 and the flange 2 to secure the housing 1 on the panel P.

An operator may mistakenly believe that the housing 1 has been mounted properly on the panel P and may stop the mounting operation even though the housing 1 has been mounted only partly. The partly mounted housing 1 is not fixed firmly to the panel P and may cause problems.

The invention was developed in view of the above problem, and an object of the invention is to prevent a connector housing from being left partly mounted on a panel.

SUMMARY OF THE INVENTION

The invention relates to a connector with a housing that can be mounted through a through hole in a panel and then connected with a mating housing. A detector is mountable into the housing or the panel and has a mount detecting portion and a connection-detecting portion. The detector is successively movable between a standby position, a mount detecting position and a connection detecting position. The movement of the detector is along a direction intersecting a mounting direction of the housing on the panel and/or a connecting direction of the two housings. The housing or the panel interferes with the mount-detecting portion while the housing is being mounted on the panel and prevents the detector from moving toward the standby position. However, the mount-detecting portion does not interfere with the housing or the panel when the housing is mounted properly. Thus, the detector can move toward the mount detecting position when the housing is mounted properly. The connection-detecting portion interferes with the mating housing while the mating housing is being connected with the housing mounted on the panel and prevents movement of the detector from the mount detecting position toward the connection detecting position. However, the connection-detecting portion does not interfere with the mating housing when the two housings are connected properly and, hence, the detector can move toward the connection detecting position.

The detector can be moved from the standby position to the mount-detecting position when the housing is mounted properly on the panel because the mount-detecting portion does not interfere with the housing or the panel. On the other hand, movement of the detector from the standby position to the mount-detecting position is prevented while the housing is being mounted on the panel due to interference of the mount-detecting portion with the other of the housing and the panel. In this way, the mounted state of the housing on the panel can be detected based on whether the detector can be moved from the standby position to the mount-detecting position.

The connection-detecting portion does not interfere with the mating housing if the two housings are connected properly. Thus, the detector can be moved from the mount-detecting position to the connection-detecting position when the mating housing is connected with the housing on the panel. The detector cannot be moved toward the connection-detecting position when the two housings are connected partly because the connection-detecting portion interferes with the mating housing. In this way, the connected state of the two housings can be detected based on whether the detector can be moved from the mount-detecting position toward the connection-detecting position.

A mounting direction of the housing on the panel preferably is substantially parallel with the connecting direction of the two housings.

The connection detecting position preferably is substantially the same as the standby position.

The detector reciprocates between the two positions. Thus, operability is improved and the construction is simplified.

The connection-detecting portion preferably engages the mating housing as the detector is moved from the mount-detecting position to the connection-detecting position to lock the connectors together.

The housing preferably is mounted from the rear side of the panel, and the detector preferably includes an operable portion that is accessible from the front side of the panel for moving the detector. Thus, even though the housing is mounted from the rear side of the panel, the detector can be moved from the front side of the panel, i.e. from the side of an operator.

The detector preferably comprises an insertion recess that allows passage of a rib on the mating housing when the detector is at the mount-detecting position. Additionally, the housing may comprise a rib-receiving portion for accommodating the rib. The rib-receiving portion substantially aligns with the insertion recess when the detector is at the mount-detecting position.

The housing preferably includes a holding means for holding the housing on the panel. The holding means preferably comprises a contact portion for contacting a first surface of the panel. The holding means also comprises a securing portion and a resilient lock for contacting a second surface of the panel and tightly holding the panel against the contact portion. The securing portion first is passed through the mount hole and engages the panel. The resilient lock then is deformed by an edge of the mount hole, passes through the mount hole and engages the panel.

The detecting portion preferably has a guide surface for correcting the posture of the housing to a proper mounting posture by sliding in contact with the mount hole when an attempt is made to move the detector to the mount detecting position before the connector housing is mounted properly.

These and other objects, features and advantages of the invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 15:
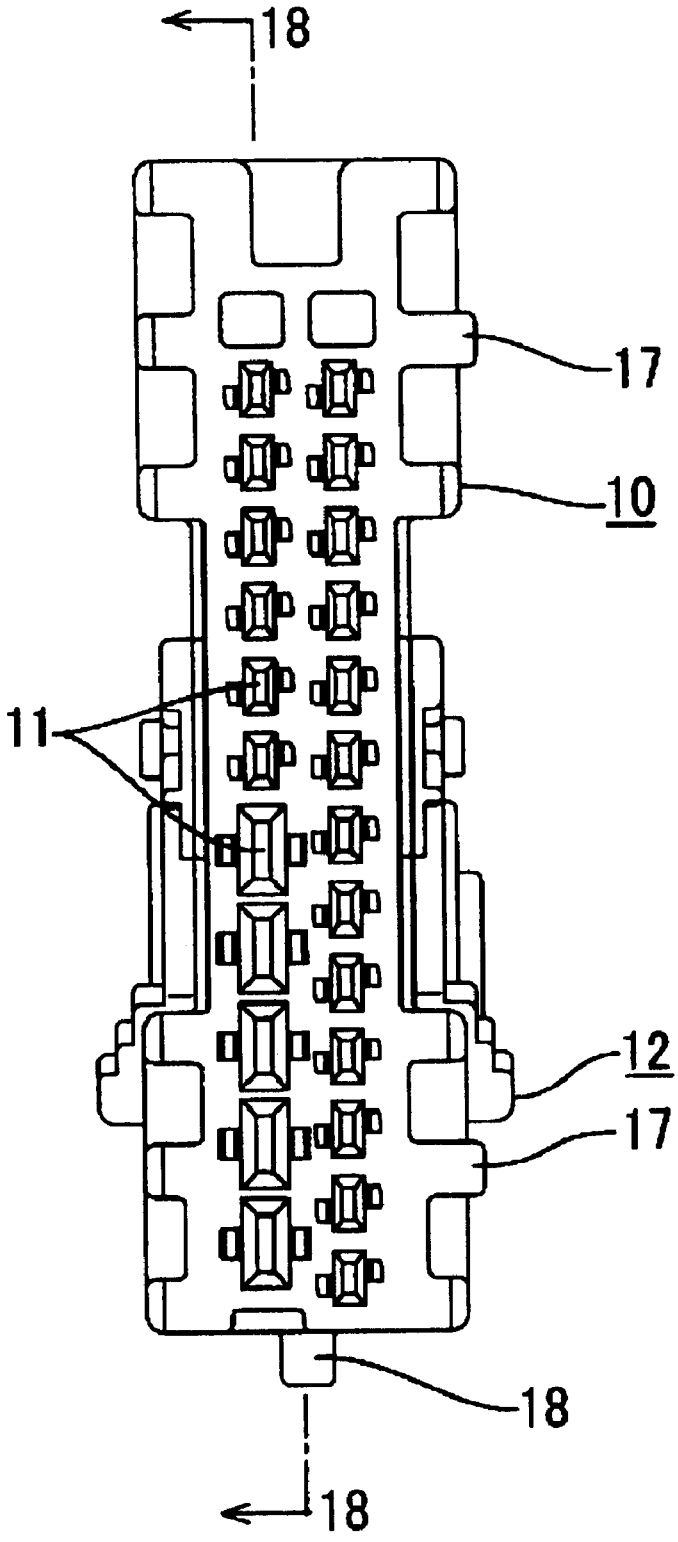
FIG. 15 is a front view of a female housing.
Figure 16:
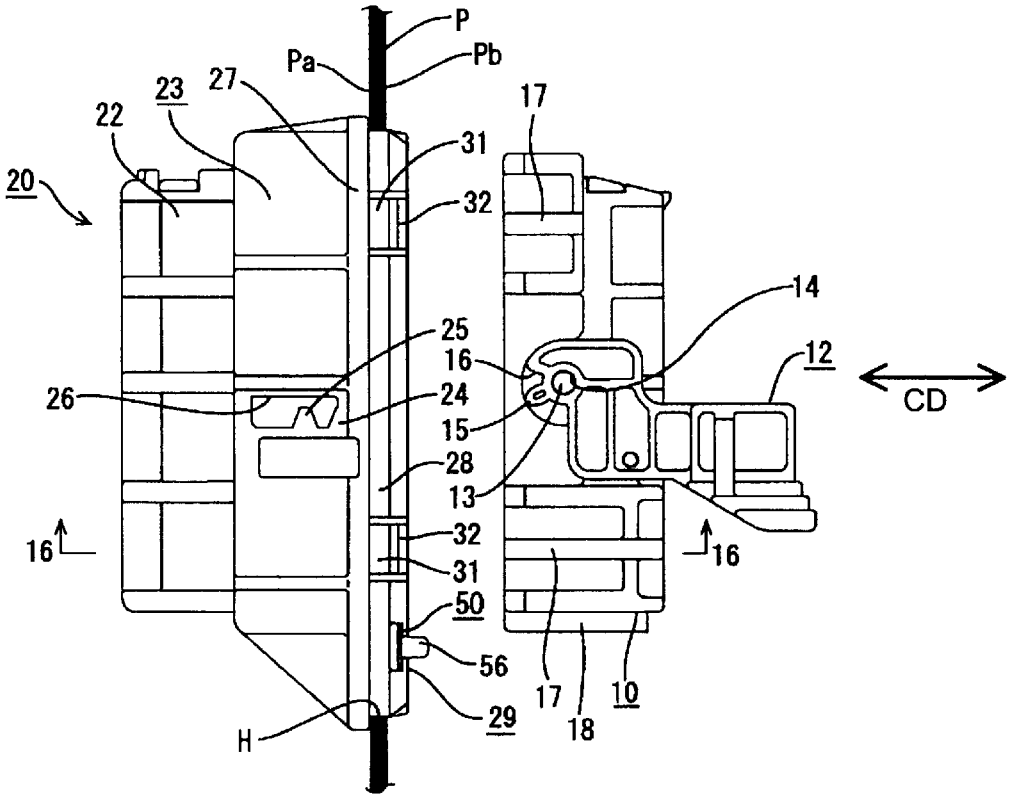
FIG. 16 is a side view showing the male housing mounted on the panel and the female housing having a lever mounted at an initial position.

A connector in accordance with the invention is illustrated in FIGS. 1 to 28 and is configured for mounting into a hole H of a door panel P of an automotive vehicle. The connector includes a substantially block-shaped female housing 10, as shown in FIGS. 15 and 16. The female housing 10 is made e.g. of a synthetic resin and is formed internally with cavities 11 for accommodating unillustrated female terminal fittings. The connector further includes a substantially U-shaped lever 12. Shaft pins 13 project from the longer outer surfaces of the female housing 10 and engage rotatably in shaft holes 14 of the lever 12 so that the lever 12 can rotate relative to the housing 10. A catch 15 and an engaging recess 16 are provided near each shaft hole 14 of the lever 12. Two slightly raised deformation preventing portions 17 are provided on the right outer surface of the female housing 10 in FIG. 15 and extend substantially along forward and backward directions. Further, a rib 18 projects from the shorter outer side surface of the female housing 10 at the bottom in FIG. 15 and extends along forward and backward directions.

Figure 1:
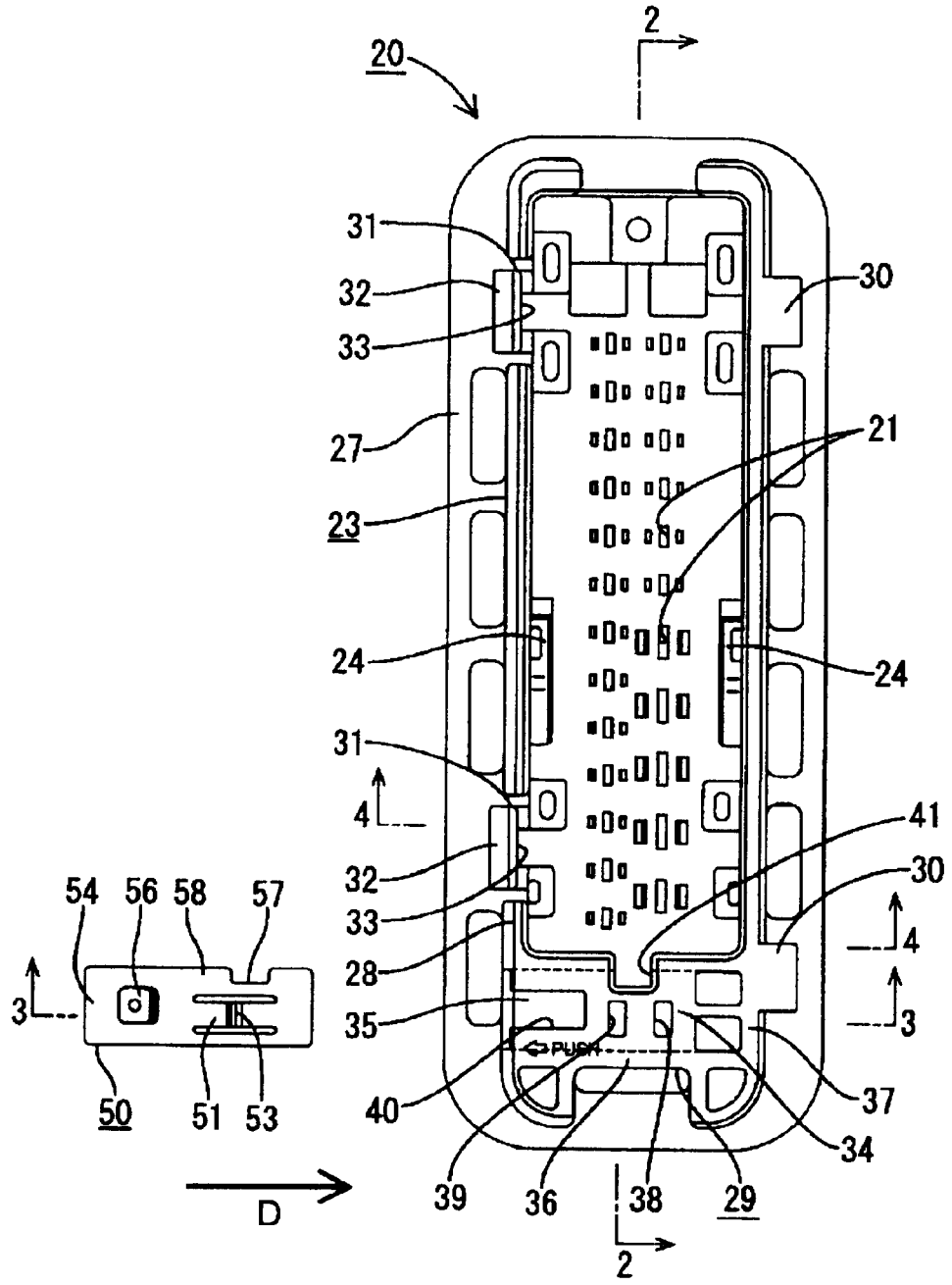
FIG. 1 is a front view of a male housing and a detector according to one embodiment of the invention.
Figure 2:
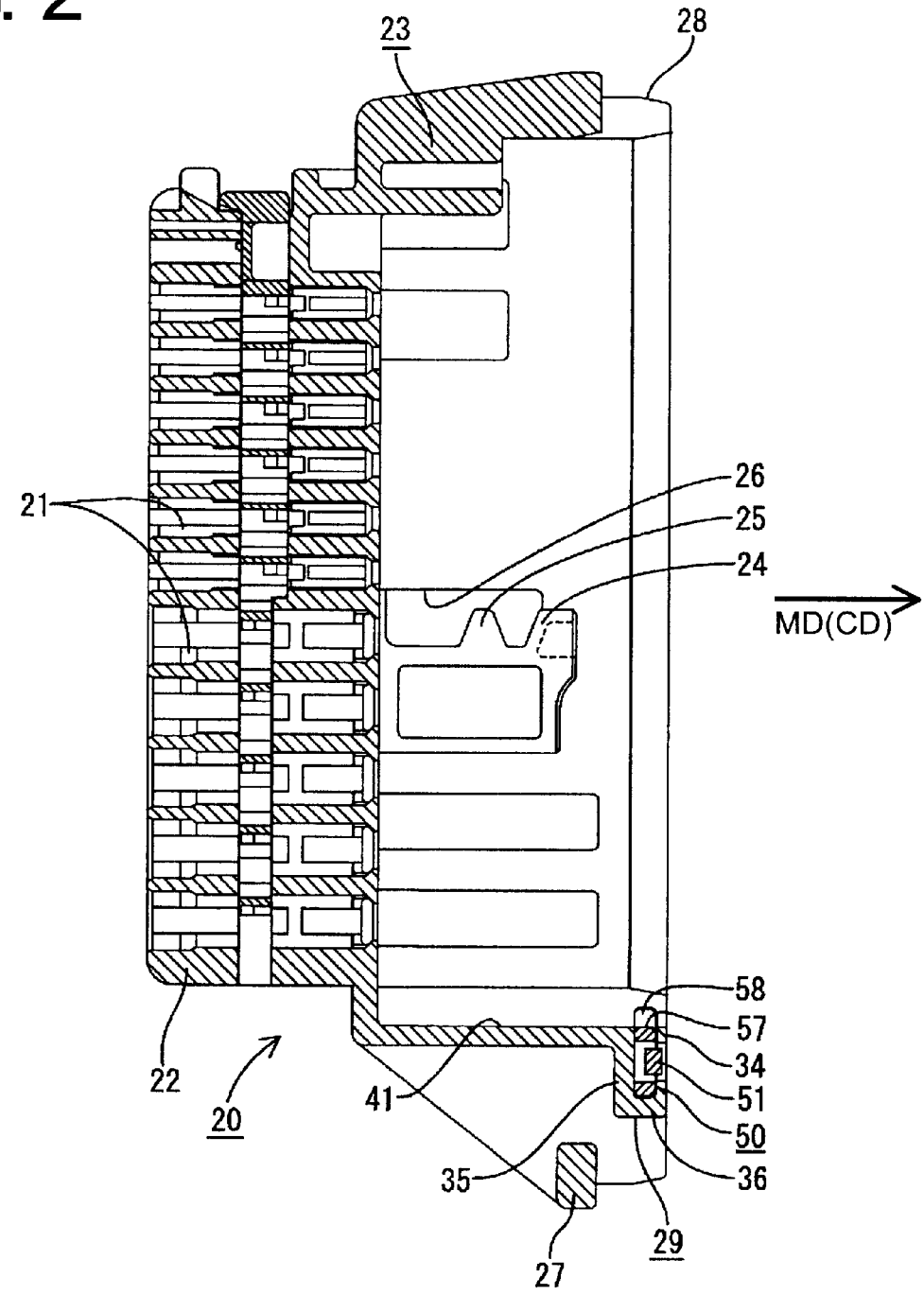
FIG. 2 is a section of the male housing along line 2—2 of FIG. 1.

The connector further includes male housing 20 that is made e.g. of a synthetic resin, as shown in FIGS. 1 and 2. Cavities 21 extend through a terminal accommodating portion 22 of the male housing 20 and are configured for accommodating male terminal fittings (not shown) at positions substantially corresponding to the cavities 11 of the female housing 10. A substantially rectangular tubular receptacle 23 projects forward from the terminal accommodating portion 22 and is configured to receive the female housing 10 from the front or mating side. Receiving portions 24 and engaging projections 25 bulge inward one after the other on the longer inner surfaces of the receptacle 23, and are disposed to align respectively with the catches 15 and the engaging recesses 16 of the lever 12. Mold-removing holes 26 open laterally on the longer walls of the receptacle 23 and are used to remove a mold for forming the receiving portions 24 and the engaging projections 25 during the molding of the male housing 20. A positional relationship between the receiving portions 24, the engaging projections 25 and the catches 15 and the engaging recesses 16 of the lever 12 can be seen from outside through the mold-removing holes 26.

A flange 27 bulges out on the outer peripheral surface of the receptacle 23 at a position slightly behind the front end of the receptacle 23. The flange 27 is dimensioned to contact a rear surface Pa of the panel P as the male housing 20 is mounted on the panel P. A penetrating portion 28 of the receptacle 23 projects forward from the flange 27 and is configured to project through the mount hole H and to the front side of the panel when the male housing 20 is mounted on the panel P. A detector-accommodating portion 29 is provided continuously at the lower side of the penetrating portion 28 in FIG. 1, and projects to the front side of the panel P together with the penetrating portion 28 by being passed through the mount hole H. The flange 27 also substantially surrounds the detector-accommodating portion 29.

Figure 4:
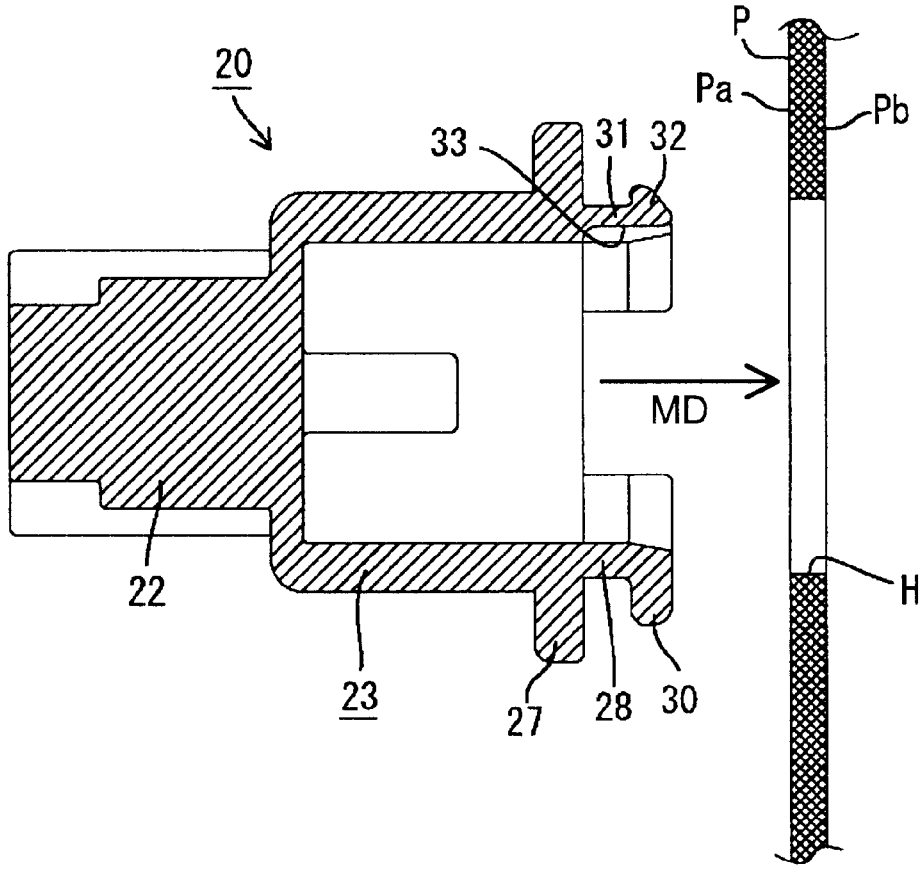
FIG. 4 is a section of the male housing and a panel along line 4—4 of FIG. 1.

Two securing portions 30 bulge out to face the flange 27 at the outer surface of the front end of the right longer wall of the penetrating portion 28 in FIG. 1. Additionally, two cantilevered resilient locks 31 are formed by slits in the left longer wall of the penetrating portion 28 in FIG. 1. The resilient locks 31 are resiliently deformable inward along a direction of the shorter sides of the male housing 20. A locking claw 32 projects from the outer surface of the front end of each resilient lock 31 and faces the flange 27 as shown in FIG. 4. The front surfaces of the locking claws 32 are slanted up and to the back.

Figure 6:
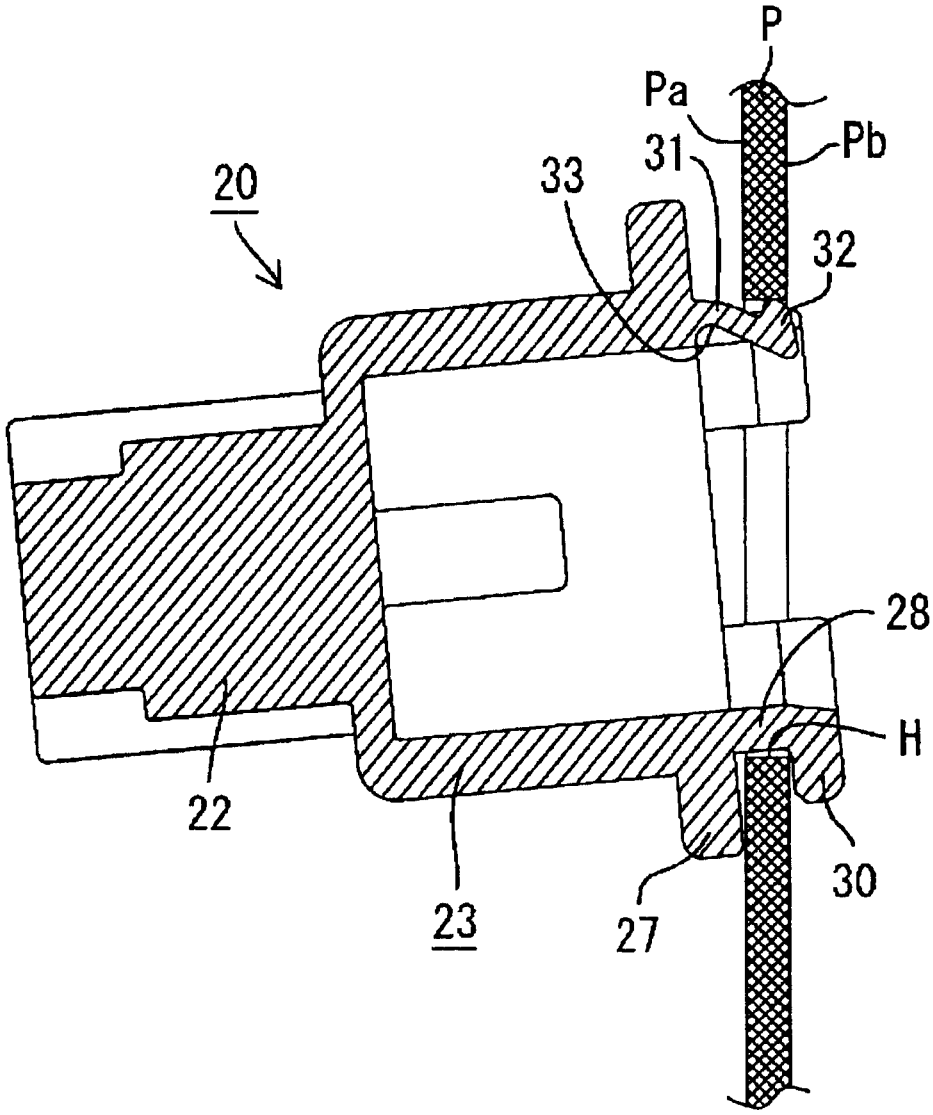
FIG. 6 is a section along 4—4 of FIG. 1 showing an intermediate stage of mounting the male housing on the panel.

The rear edge of the mount hole H pushes the slanted surface of the resilient locks 31 during the mounting process and deforms the resilient locks 31 inwardly due to the inclination of the slanted surfaces (see FIG. 6). The locking claws 32 pass the rear surface Pb of the panel P substantially when the flange 27 engages the front surface Pa of the panel P, and hence the resilient locks 31 are restored resiliently. Thus, the panel P is sandwiched tightly between the flange 27 on the front surface Pa and both the securing portions 30 and the locking claws 32 on the rear surface Pb (see FIG. 8). The securing portion 30 and the resilient lock 31 at the upper side in FIG. 1 are at substantially the same height. However, the securing portion 30 at the lower side is coupled to the detector-accommodating portion 29 and is below the resilient lock 31 at the lower side.

A groove 33 is formed in the inner surface of each resilient lock 31 to facilitate deformation. The deformation preventing portions 17 of the female housing 10 can enter the grooves 33 when the resilient locks 31 are in an unbiased state. However, the deformation preventing portions 17 cannot enter the grooves 33 when the resilient locks 31 are deformed inward. Entrance of the deformation preventing portions 17 into the grooves 33 prevents deformation of the resilient locks 31 (see FIG. 24). A specified space inside each resilient lock 31, including the groove 33, defines a deformation space for permitting resilient deformation of the resilient lock 31.

Figure 3:
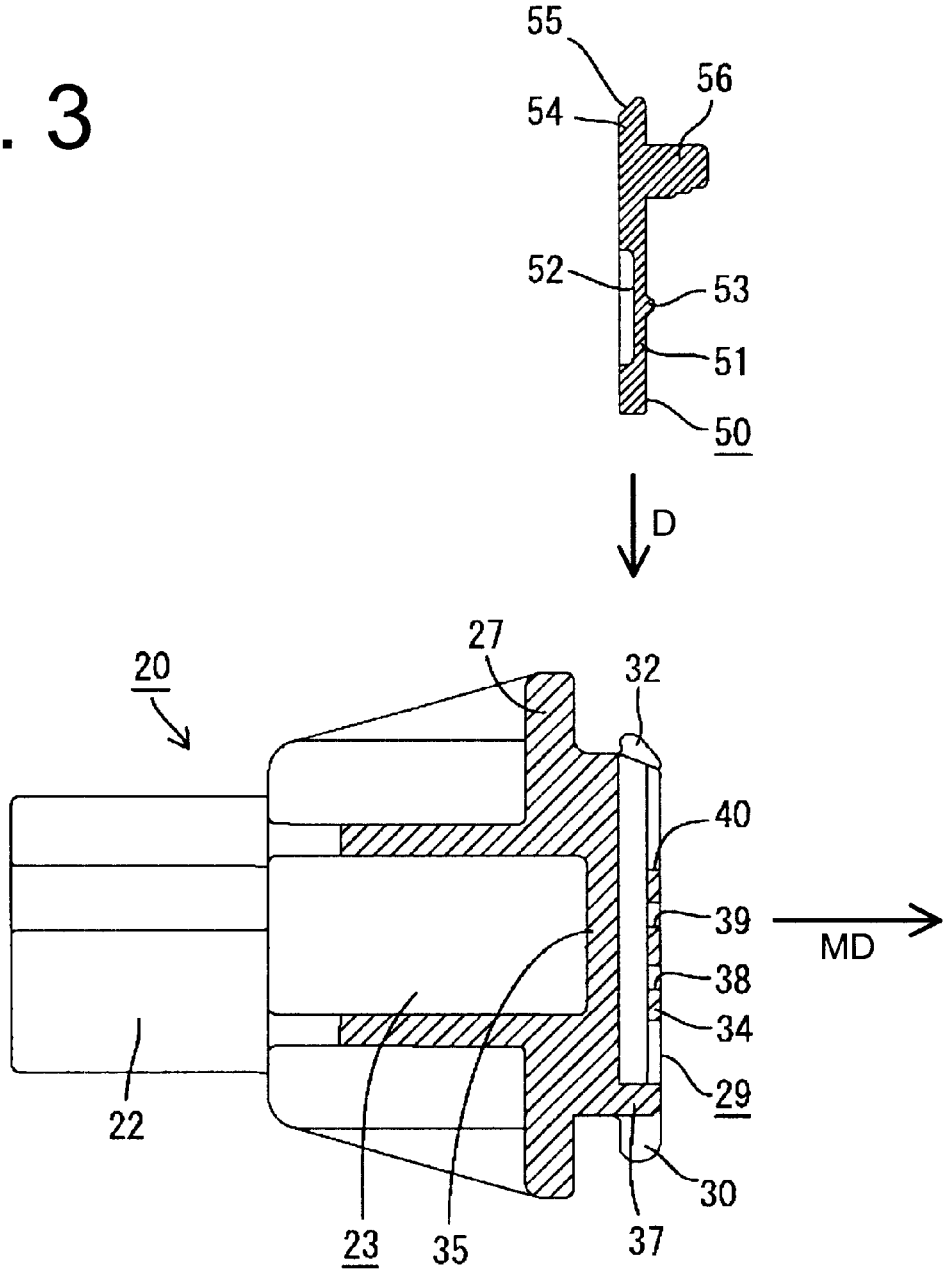
FIG. 3 is a section taken along line 3—3 of FIG. 1.

As shown in FIGS. 1 and 3, the detector-accommodating portion 29 has front and rear walls 34, 35 that bulge out from the shorter sides of the penetrating portions 28 substantially along the longer sides thereof. The bottom ends of the walls 34, 35 in FIG. 1 are coupled by a side wall 36 and the right ends of the walls 34, 35 are coupled by a stop wall 37. Thus, the detector-accommodating portion 29 defines a bottomed hole that opens to the left in FIG. 1. The front wall 34 of the detector-accommodating portion 29 projects to the front side Pb of the panel P when the male housing 20 is mounted on the panel P. However, the front surface of the rear wall 35 of the detector-accommodating portion 29 is substantially flush with the front surface Pb of the panel P (see FIG. 9). A rib receiving groove 41 bulges down and out over substantially the entire length at the lower shorter side of the receptacle 23 in FIG. 1, and the rib 18 of the female housing 10 is insertable into the groove 41. The front and rear walls 34, 35 are recessed to conform substantially to the shape of a rib receiving groove 41, and the rib 18 of the female housing 10 is insertable into these recessed portions.

The detector 50 is a substantially rectangular plate that is insertable into the detector-accommodating portion 29. More particularly, the detector 50 is movable left to right in FIG. 1 parallel to the plane of the panel P along a moving direction D. The moving direction D is substantially normal to the mounting direction MD of the male housing 20 onto the panel P and substantially normal to the connecting direction CD of the two housings 10, 20. A resiliently deformable holding arm 51 is supported at both ends at a position on the detector 50 toward the right side in FIG. 1, and is formed by two slits that extend substantially parallel to the moving direction D. A groove 52 is formed in the rear surface of the holding arm 51 to facilitate the resilient deformation. A holding projection 53 is provided on the front surface of the holding arm 51. The detector 50 can be held at a standby position shown in FIGS. 9 and 10 and a detecting position shown in FIGS. 11 and 12 by engaging the holding projection 53 with a standby position holding hole 38 and a detecting position holding hole 39 formed in the front wall 34 of the detector accommodating portion 29. Opposite side surfaces of the holding projection 53 that engage the holding holes 38, 39 are slanted or rounded to define a substantially pointed shape. Thus, an operation force of at least a specified intensity applied to the detector 50 acts on the pointed holding projection 53 and the holding hole 38 or 39. As a result, the holding arm 51 deforms sufficiently for the holding projection to disengage from the holding hole 38 or 39 and the detector 50 can move in the moving direction D.

Figure 9:
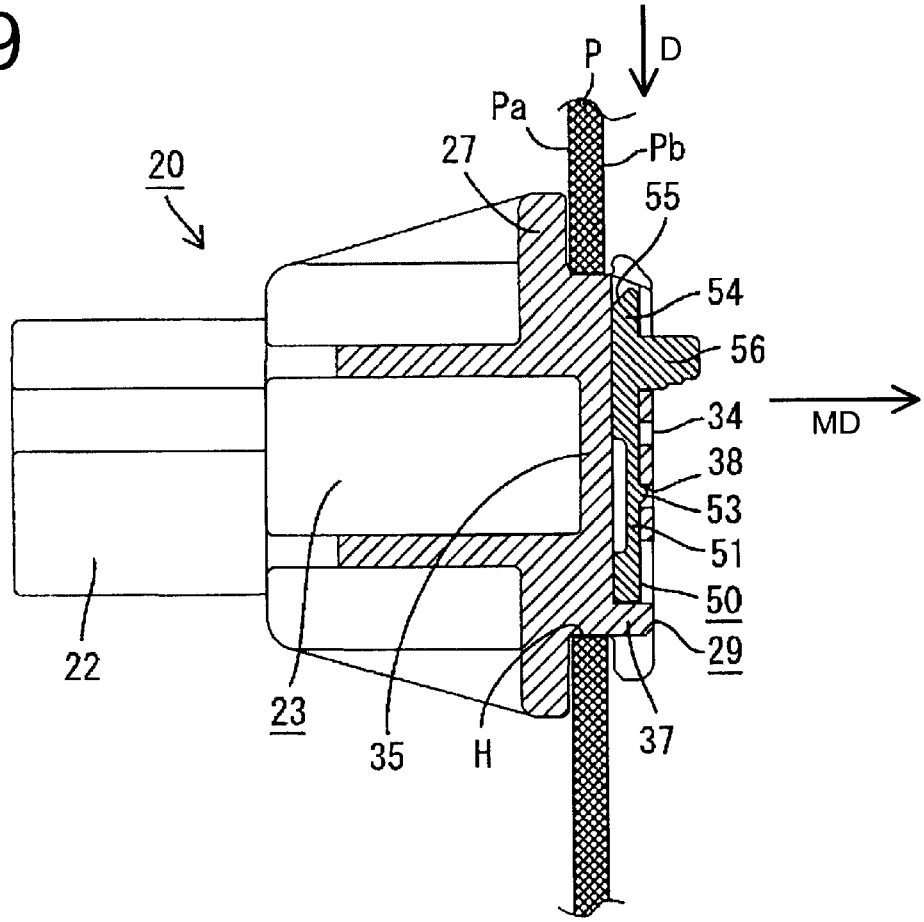
FIG. 9 is a section along 3—3 of FIG. 1 showing the state where the male housing is mounted properly on the panel.
Figure 10:
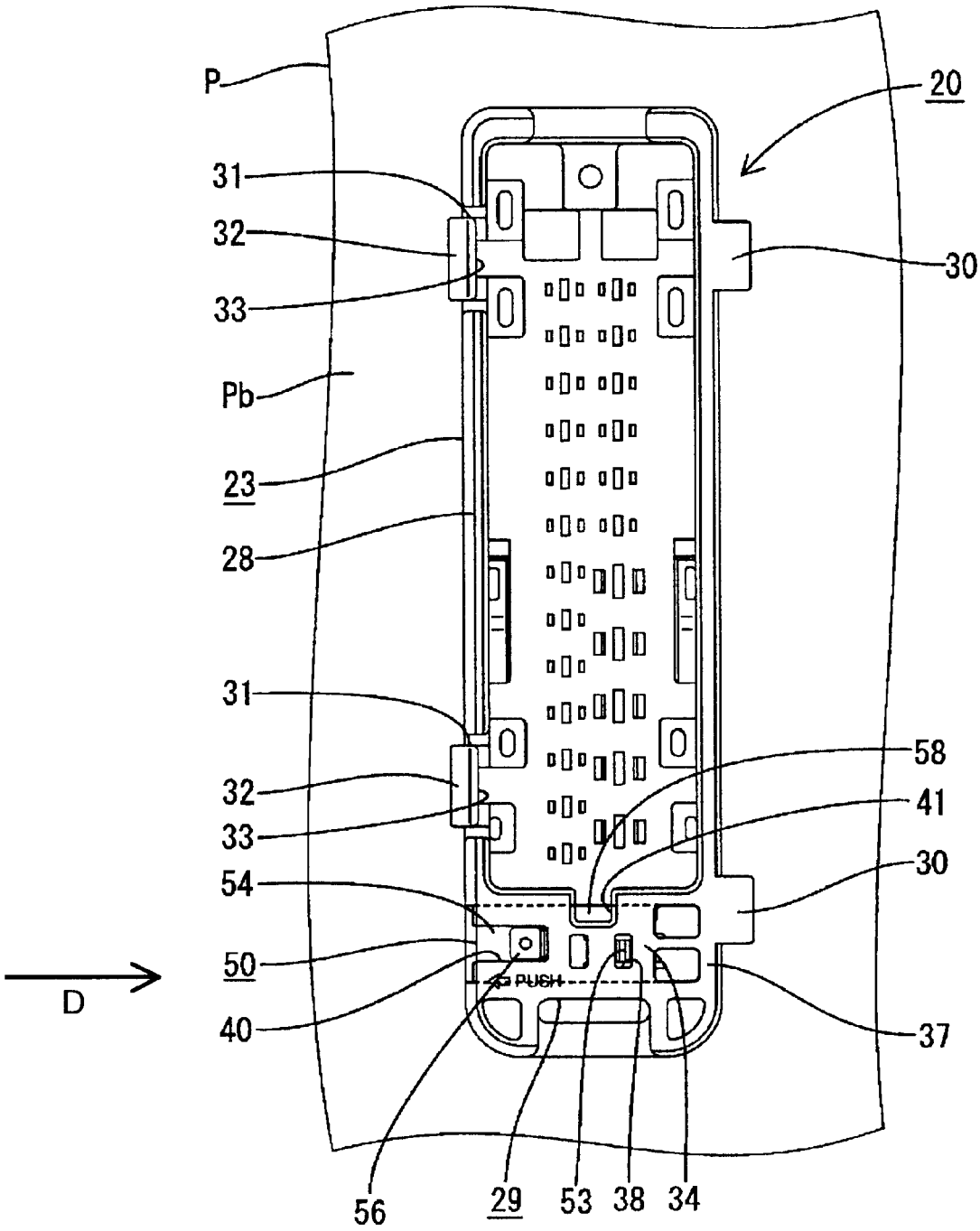
FIG. 10 is a front view showing the state where the male housing is mounted properly on the panel.

The upper end of the detector 50 in FIG. 9 defines a mount detecting end 54 that is completely in the detector-accommodating portion 29 when the detector 50 is in the standby position shown in FIGS. 9 and 10. Additionally, the stop wall 37 prevents the detector 50 from moving in the direction D beyond the standby position of FIGS. 9 and 10. On the other hand, the mount detecting end 54 of the detector 50 projects from the detector accommodating portion 29 when the detector 50 is in the mount detecting position of FIGS. 11 and 12. The mount detecting end 54 is not entirely on the front side of the panel P until the male housing 20 is mounted properly on the panel P. Accordingly, the mount detecting end 54 is in the mount hole H at an intermediate stage of the mounting operation of the male housing 20 on the panel P. Thus, the inner peripheral surface of the mount hole H prevents movement of the detector 50 toward the mount detecting position before the housing is mounted properly on the panel P (see FIG. 13). On the other hand, the mount detecting end 54 projects to the front side of the panel P and does not interfere with the inner peripheral surface of the mount hole H when the male housing 20 is mounted properly on the panel P. Thus, the detector 50 can move to the mount detecting position and engages the front surface Pb of the panel P at the side of the resilient locks 31 and opposite from the securing portions 30. Thus, the panel P is held tightly between the mount-detecting end 54 and the flange 27.

Figure 14:
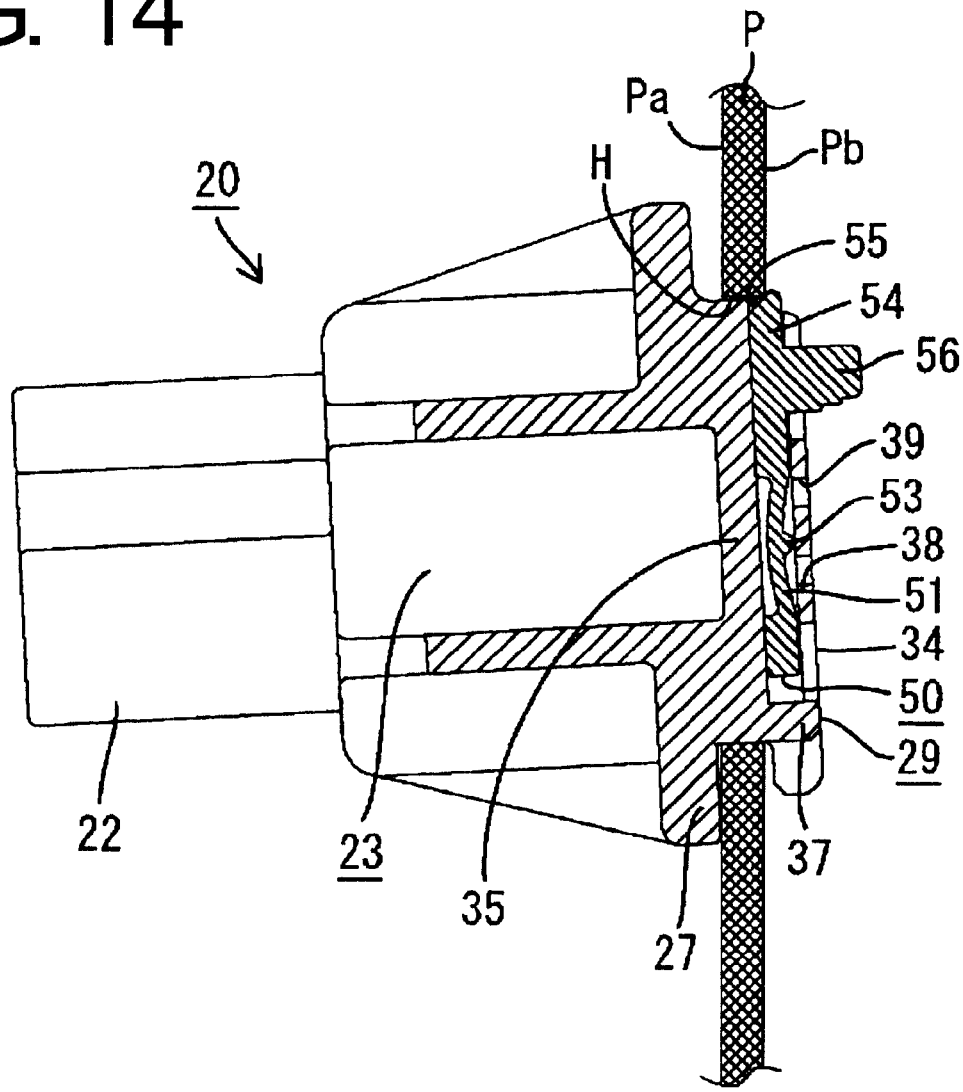
FIG. 14 is a section along 3—3 of FIG. 1 showing a state where a guide surface is in contact with the front edge of the mount hole.

A guide surface 55 is formed at the rear side of the leading end of the mount detecting end 54, as shown in FIG. 3 and slopes down and back in the moving direction D toward the rear side of the detector 50 The guide surface 55 contacts the front edge of the mount hole H if an attempt is made to move the detector 50 toward the mount detecting position when only the front end of the mount-detecting end 54 projects toward the front side of the panel P (see FIG. 14). Thus, the guide surface 55 slides in contact with the front edge of the mount hole H as the detector 50 is moved further toward the mount detecting position to guide the male housing 20 to a proper mounting posture.

An operable portion 56 projects forward between the holding arm 51 and the mount-detecting end 54 on the front surface of the detector 50, as shown in FIG. 1. The operable portion 56 projects forward through a slot 40 in the front wall 34 when the detector 50 is in the detector-accommodating portion 29 and to the front side of the panel P when the male housing 20 is on the panel P. Accordingly, the detector 50 can be moved by pushing the operable portion 56 from the front side of the panel P. The bottom surface of the operable portion 56 in FIG. 3 is stepped so that a finger can be placed easily during operation.

An insertion recess 57 is formed on the upper end of the detector 50 toward the front side with respect to the moving direction D as shown in FIG. 1. This insertion recess 57 aligns with the inner surface of the rib-receiving groove 41 when the detector 50 is at the mount detecting position to permit insertion of the rib 18 (see FIG. 21). On the other hand, the insertion recess 57 does not align with the inner surface of the rib-receiving groove 41 when the detector 50 is at the standby position. Rather, a connection-detecting portion 58 of the detector 50 is in the rib-receiving groove 41 and prevents insertion of the rib 18 (see FIG. 26).

The rib 18 can be inserted into the insertion recess 57 and the rib-receiving groove 41 if the female housing 10 is connected with the male housing 20 and if the detector 50 is at the mount detecting position. However, the rib 18 is in the insertion recess 57 while the two housings 10, 20 are being connected. Thus, an attempt to move the detector 50 toward the standby position is prevented by interference of the connection-detecting portion 58 and the rib 18 (see FIGS. 21 and 22). On the other hand, the rib 18 is retracted from the insertion recess 57 and the rear end surface of the rib 18 is substantially flush with the front end surface of the rear wall 35 when the two housings 10, 20 are connected properly. Thus, the connection-detecting portion 58 does not interfere with the rib 18 and the detector 50 can be moved toward the standby position (see FIG. 25). As a result, the connection-detecting portion 58 engages the rear end surface of the rib 18 when the detector 50 is moved toward the standby position to lock the female housing 10 and prevent disconnection (see FIGS. 26 and 27).

In this way, the connected state of the two housings 10, 20 can be detected by moving the detector 50 from the mount detecting position toward the standby position. In other words, the connection detecting position is set at the same position as the standby position in this embodiment.

Figure 5:
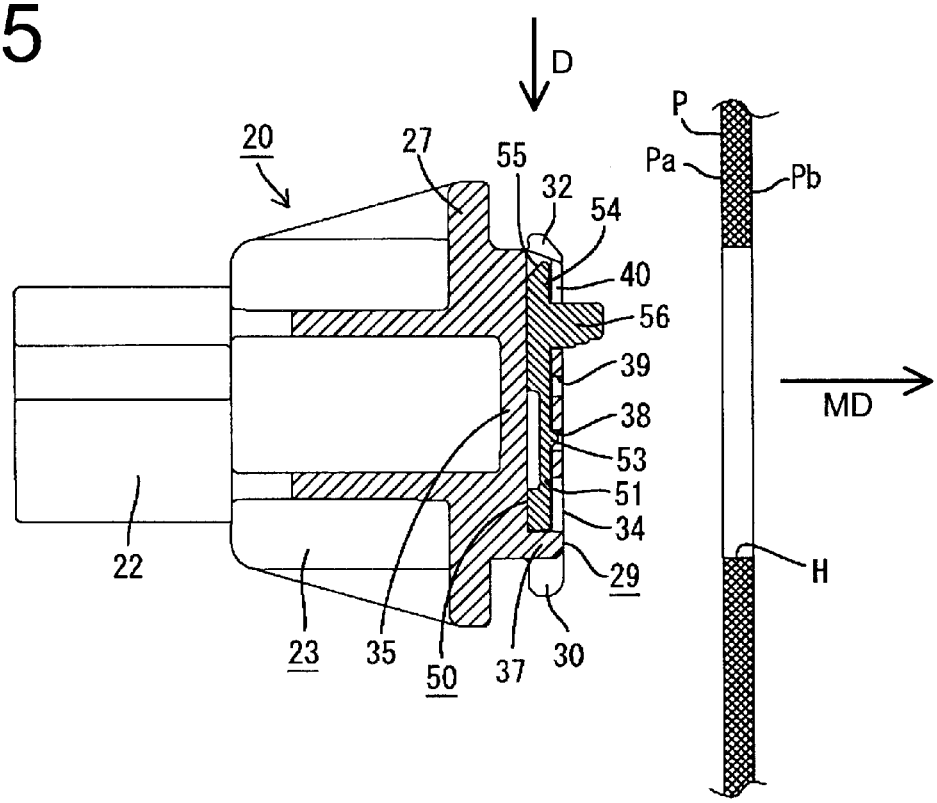
FIG. 5 is a section along 2—2 of FIG. 1 showing the panel and the male housing having the detector mounted at a standby position.

The male housing 20 can be mounted from the rear side of the panel P, as shown in FIGS. 4 and 5, when the detector 50 is at the standby position in the detector accommodating portion 29. Alternatively, an operator at the front side of the panel P can bring his hand to the rear side of the panel P to grab the male housing 20 around the panel P for performing this mounting operation if there is insufficient operating space at the rear side of the panel P.

Figure 7:
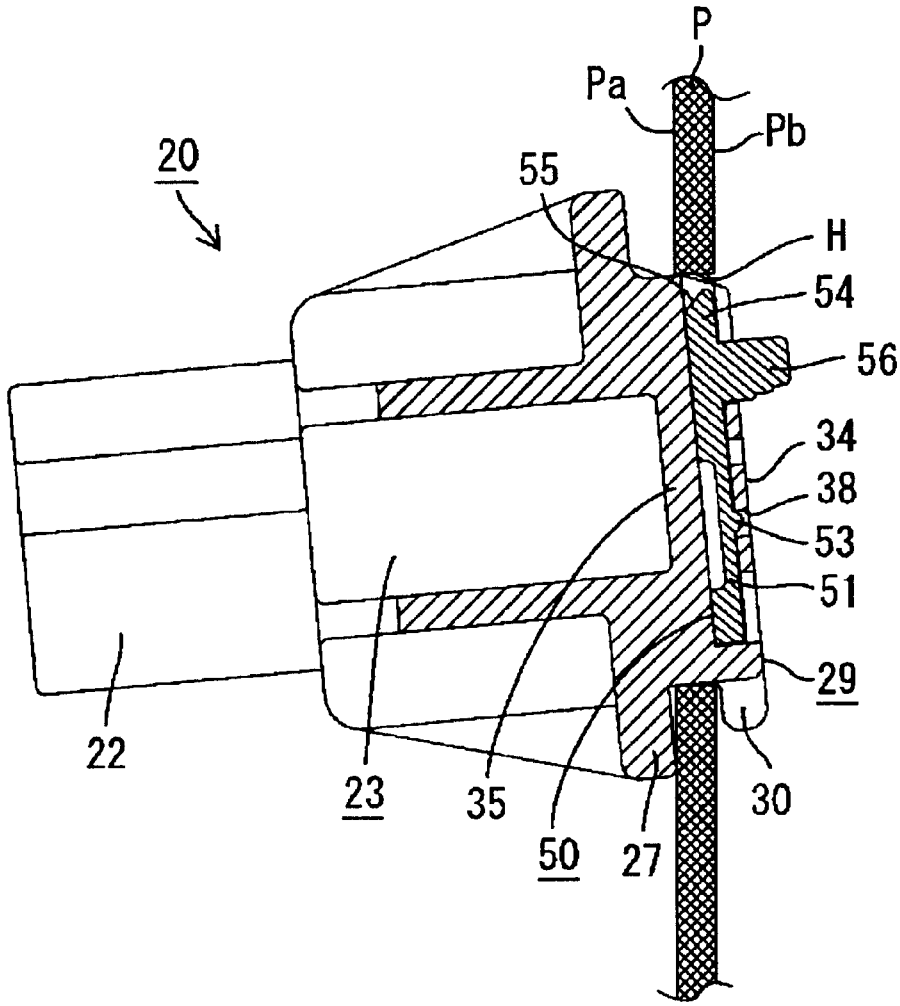
FIG. 7 is a section along 3—3 of FIG. 1 showing the intermediate stage of mounting the male housing on the panel.
Figure 8:
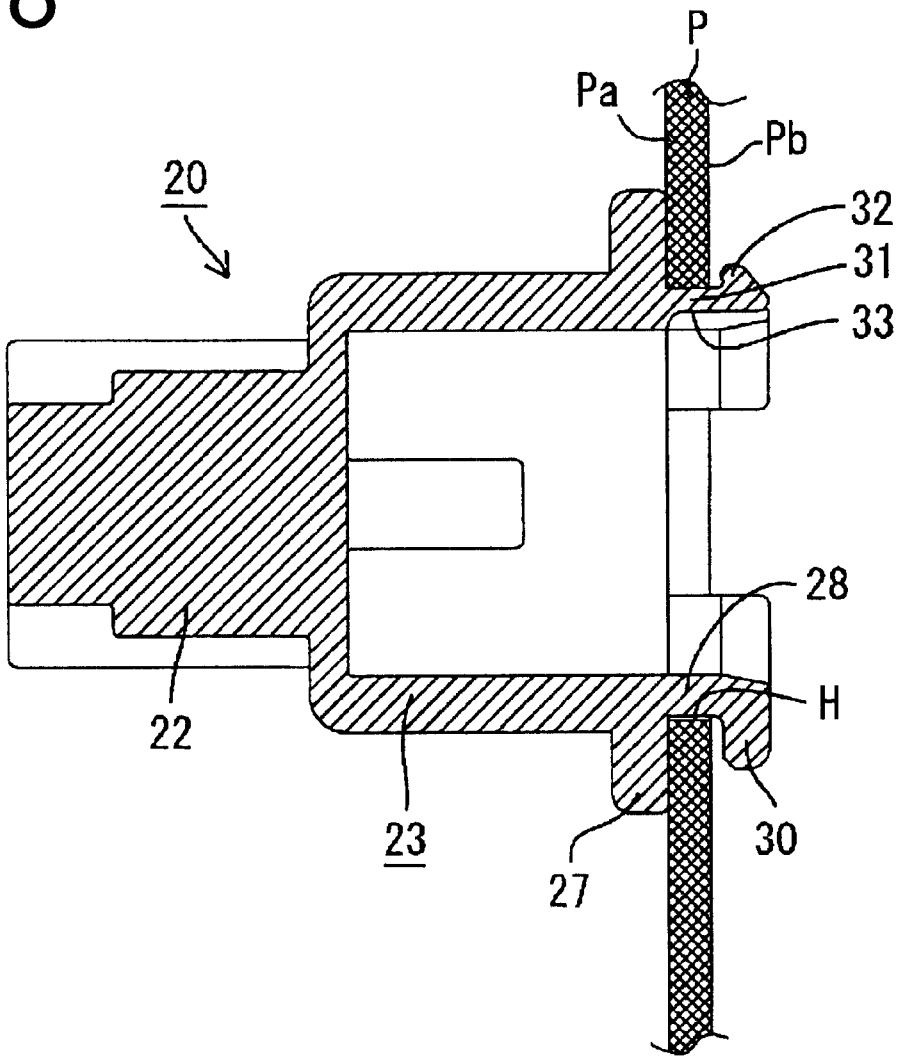
FIG. 8 is a section along 4—4 of FIG. 1 showing a state where the male housing is mounted properly on the panel.

The male housing 20 is inclined so that the shorter sides extend obliquely up and back. Both securing portions 30 then are passed through the mount hole H and engage the front surface Pb of the panel P. The male housing 20 then is pivoted about the securing portions 30 so that the slanted surfaces of the resilient locks 31 press the rear edge of the mount hole H. Thus, the resilient locks 31 deform, as shown in FIG. 6, and are pushed through the mount hole H. In this process, the detector 50, at the standby position passes through the mount hole H without interference, as shown in FIG. 7. The resilient locks 31 will have passed entirely through the mount hole H when the entire front surface of the flange 27 contacts the rear surface Pa of the panel P. As a result, the resilient locks 31 are restored resiliently, and the locking claws 32 engage the front surface Pb of the panel P, as shown in FIG. 8. In this way, the panel P is held tightly held between the flange 27 and the securing portions 30 on one side and the locking claws 32 of the resilient locks 31 on the other side.

Figure 11:
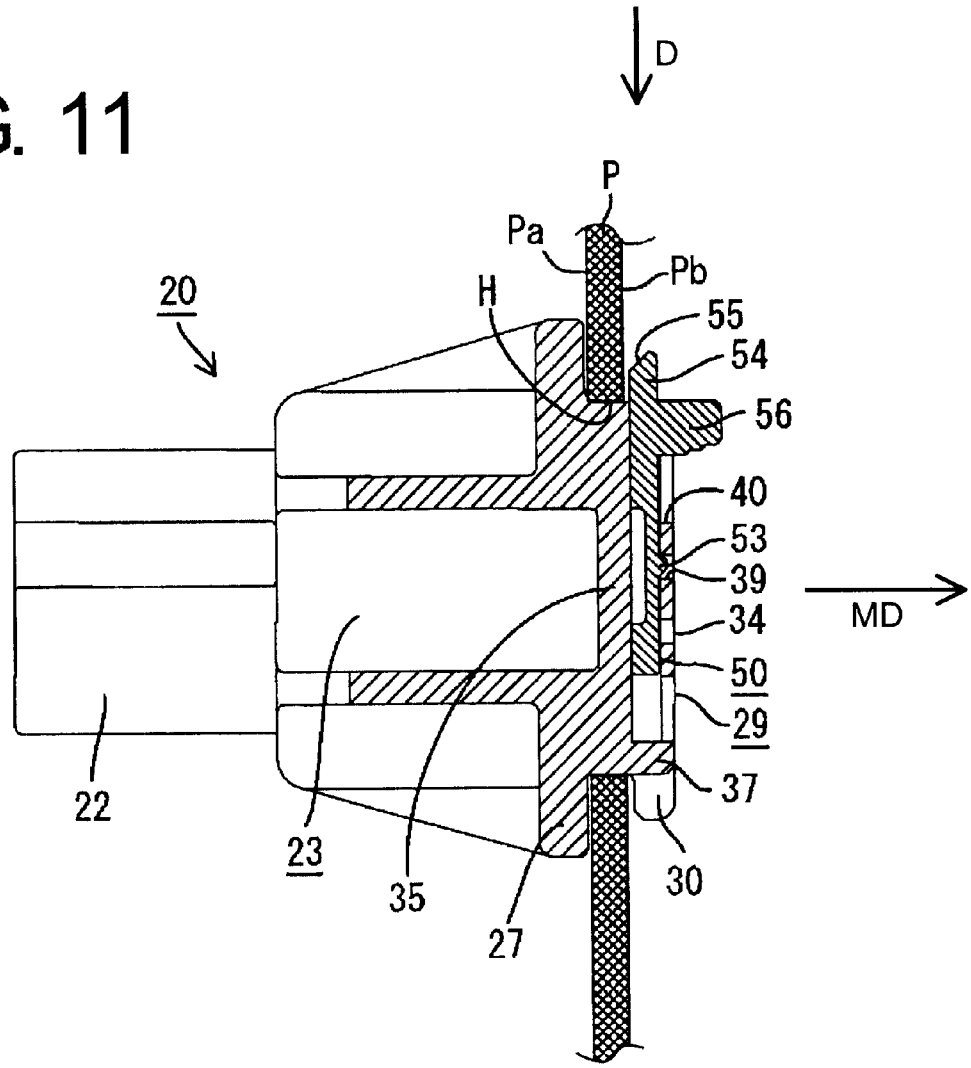
FIG. 11 is a section along 3—3 of FIG. 1 showing a state reached by moving the detector to a mount-detecting position.
Figure 12:
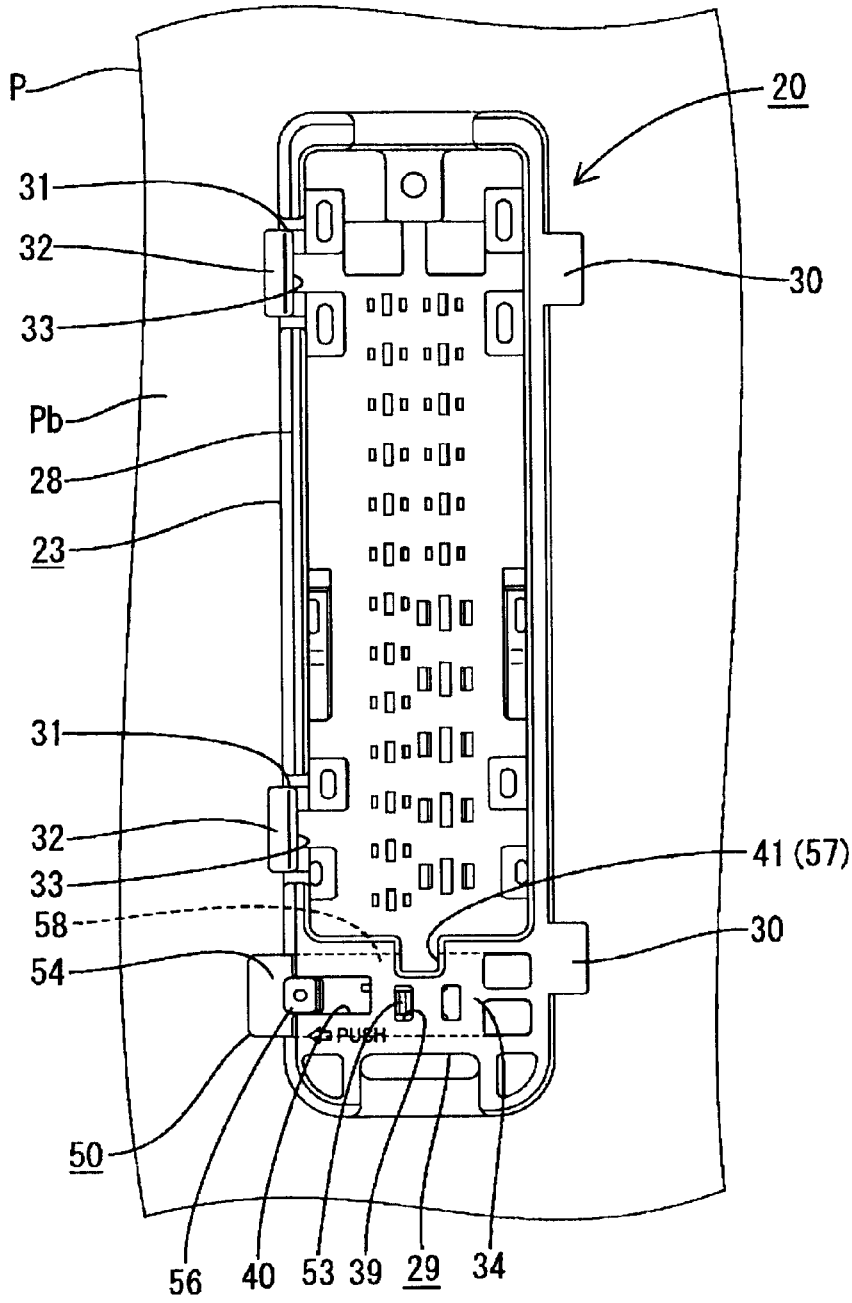
FIG. 12 is a front view showing the state reached by moving the detector to the mount-detecting position.
Figure 13:
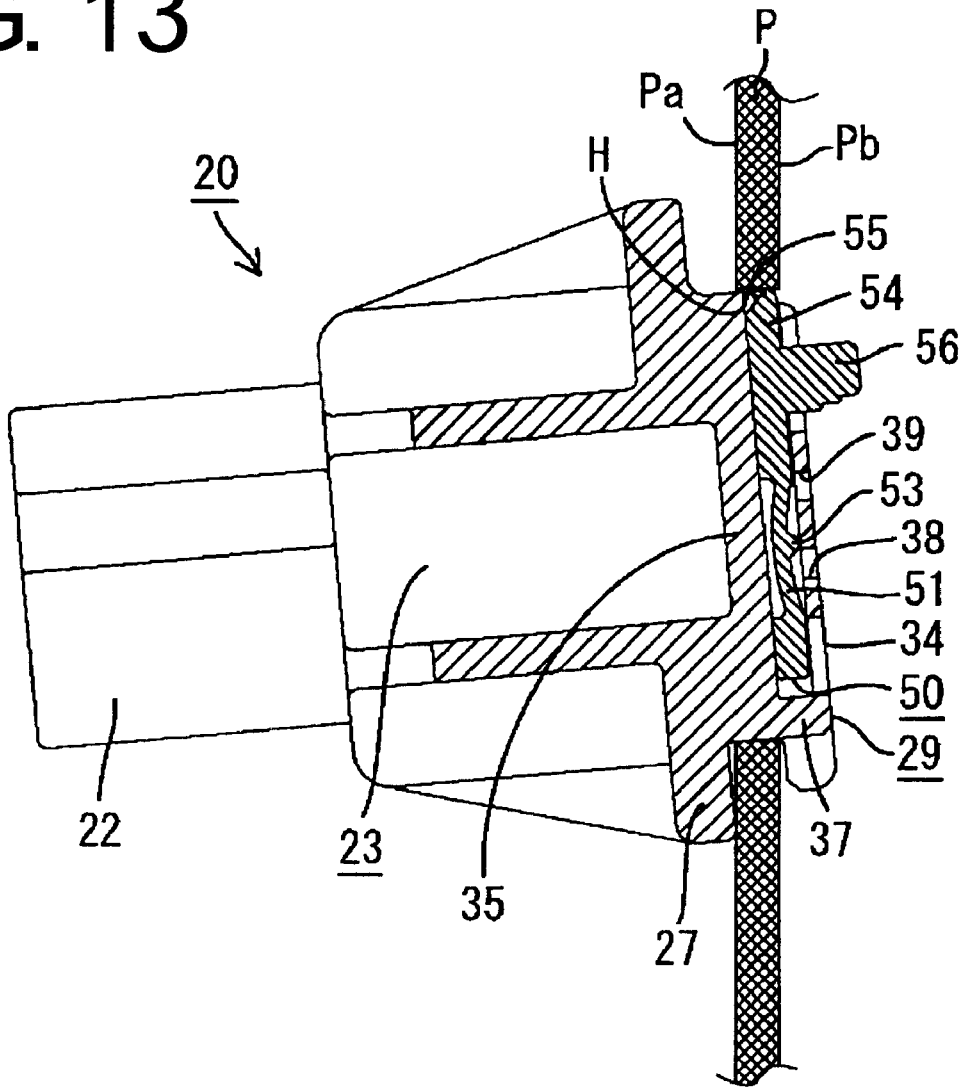
FIG. 13 is a section along 3—3 of FIG. 1 showing a state where a detecting portion interferes with the inner surface of a mount hole.

At this stage, the penetrating portion 28 and the detector-accommodating portion 29 have passed through the mount hole H, and the front surface of the rear wall 35 has become substantially flush with the front surface Pb of the panel P. Additionally, the detector 50 has passed completely through the mount hole and to the front side of the panel P, as shown in FIGS. 9 and 10, and into a position where the mount detecting end 54 of the detector cannot interfere with the inner circumferential surface of the mount hole H. The operable portion 56 then is pushed from the front side of the panel P to move the detector 50 to the mount detecting position, as shown in FIGS. 11 and 12. In this way, the properly mounted state of the male housing 20 on the panel P can be confirmed. The mount detecting end 54 engages the front surface Pb of the panel P at the side of the resilient locks 31 when the detector 50 is at the mount detecting position. Thus, the mount detecting end 54 cooperates with the securing portions 30 at the opposite side of the male housing 20 to ensure proper mounting of the male housing 20 on the panel P even if the resilient locks 31 inadvertently are deformed and disengaged from the panel P by the interference of another part.

The operator may mistakenly believe that the male housing 20 is properly mounted even though the male housing 20 is only in the partly mounted condition shown in FIG. 7. However, the mount detecting end 54 will align with the inner circumferential surface of the mount hole H when the male housing 20 is in the orientation shown in FIG. 13, and the detector 50 will be unable to move to the mount detecting position. Thus, the operator receives a clear indication that the male housing 20 is not yet completely mounted, and will try again to mount the male housing 20 properly. In this way, the mounted state of the male housing 20 on the panel P can be detected based on whether the detector 50 can be moved from the standby position to the mount detecting position after the male housing 20 is mounted on the panel P.

An attempt could be made to move the detector 50 to the mount detecting position immediately before the male housing 20 is mounted properly on the panel P. At this stage, only part of the mount detecting end 54 projects to the front side of the panel P. However, the slanted guide surface 55 will contact the front edge of the mount hole H when the detector 50 is moved toward the mount detecting position, as shown in FIG. 14. The guide surface 55 will slide in contact with the front edge of the mount hole H as the detector 50 is pushed further toward the mount detecting position. This sliding contact pulls the male housing 20 in the moving direction MD and into the proper mounting posture shown in FIG. 1 without mounting the male housing 20 again.

Figure 17:
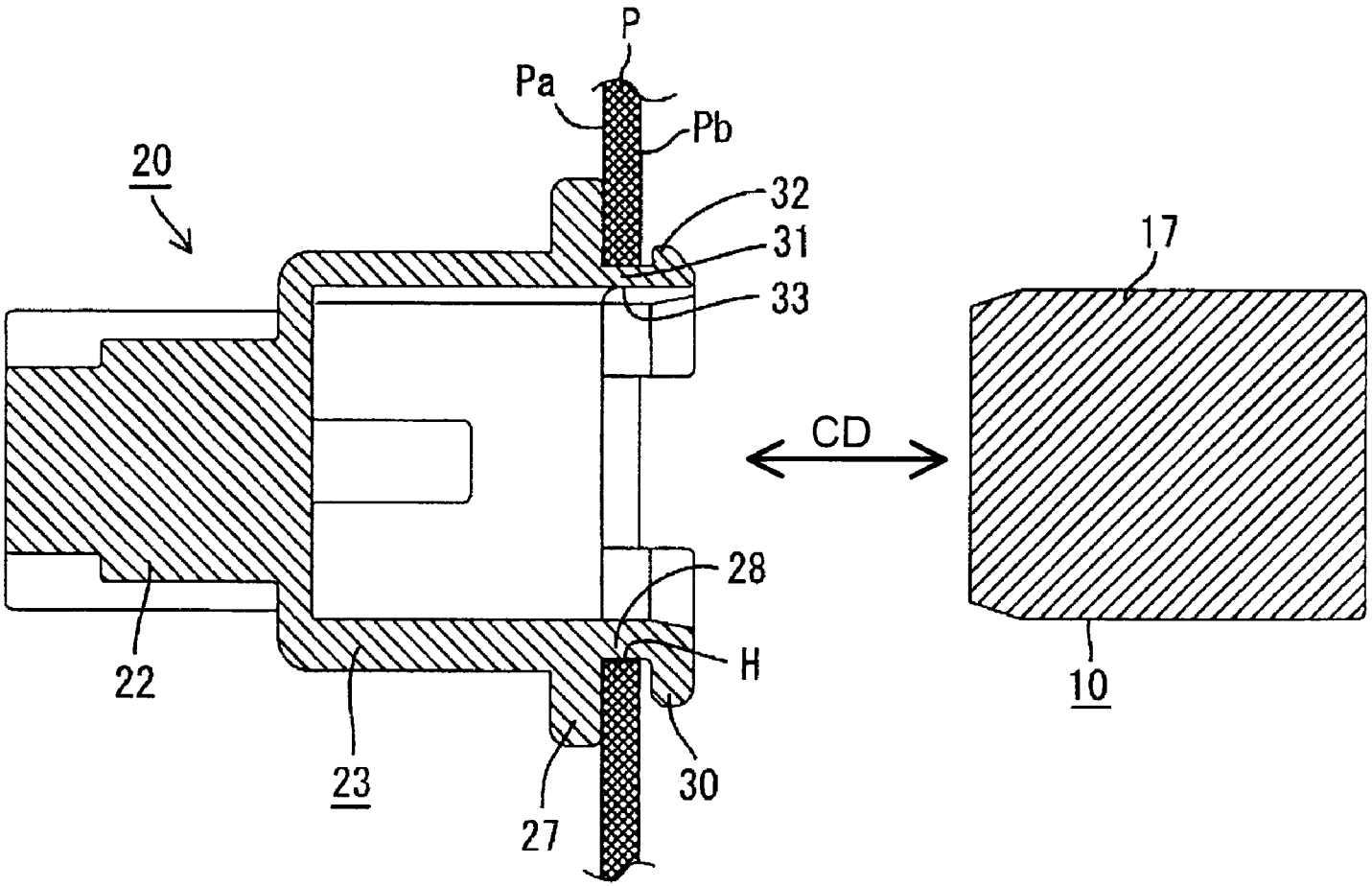
FIG. 17 is a section taken along line 17—17 of FIG. 16.
Figure 18:
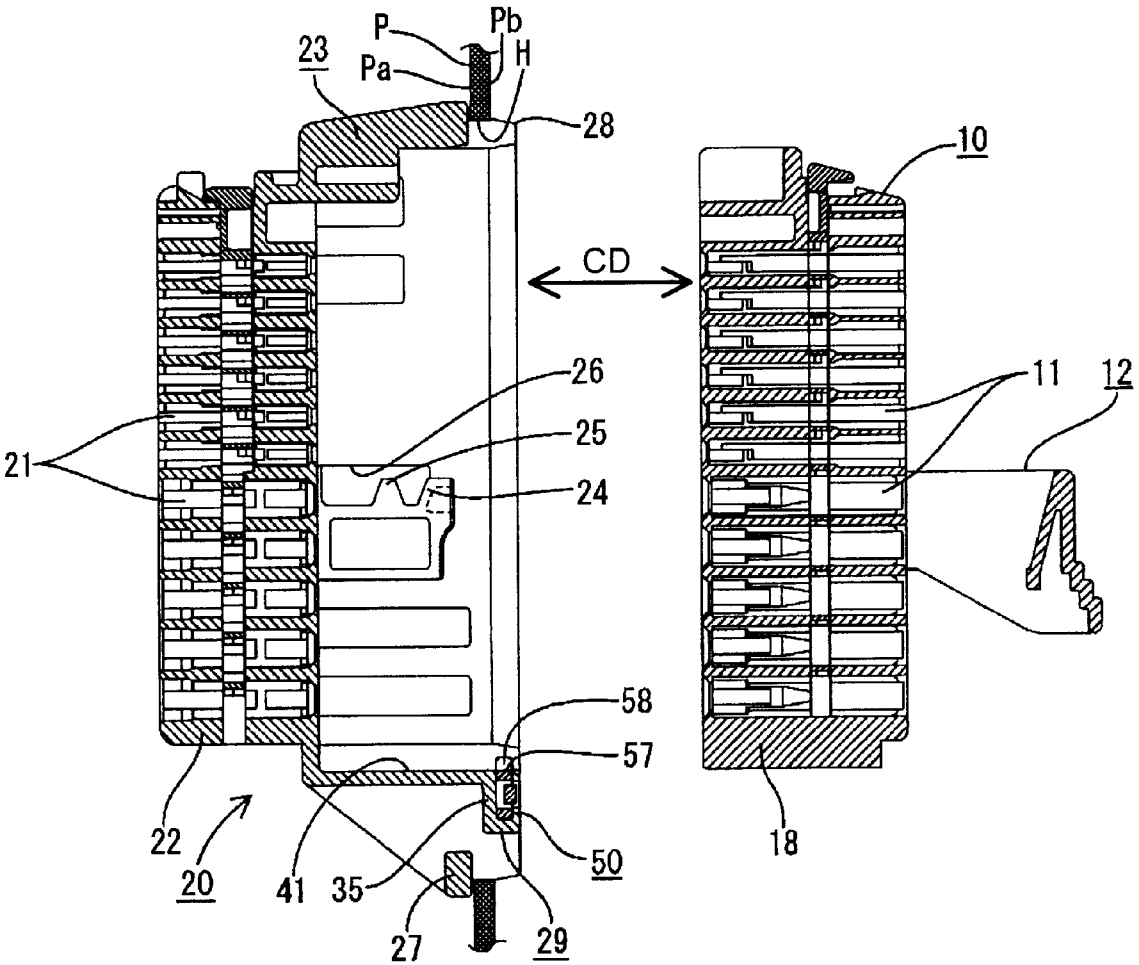
FIG. 18 is a section along line 2—2 of FIG. 1 and line 18—18 of FIG. 15 showing the male housing mounted on the panel and the female housing having the lever mounted at the initial position.
Figure 19:
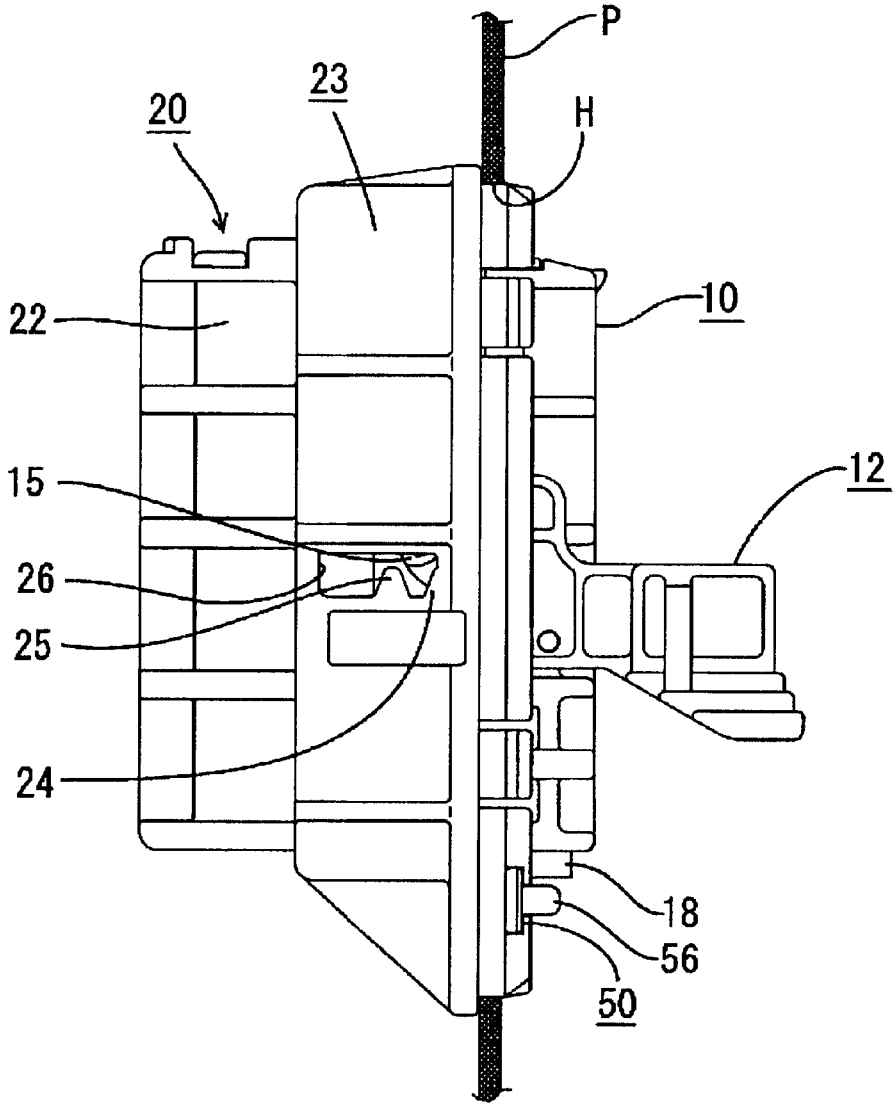
FIG. 19 is a side view showing a state where the male and female housings are connected to a specified depth.
Figure 20:
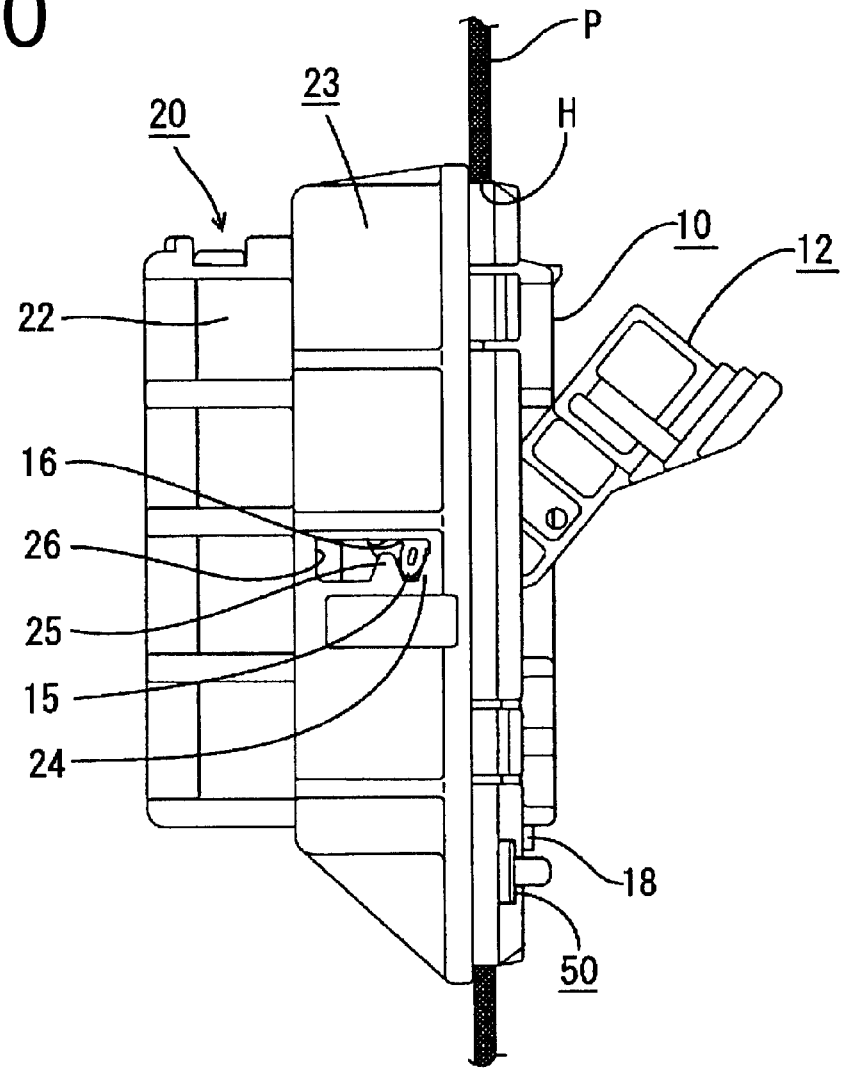
FIG. 20 is a side view showing an intermediate stage of connection of the male and female housings while the lever is being rotated.
Figure 21:
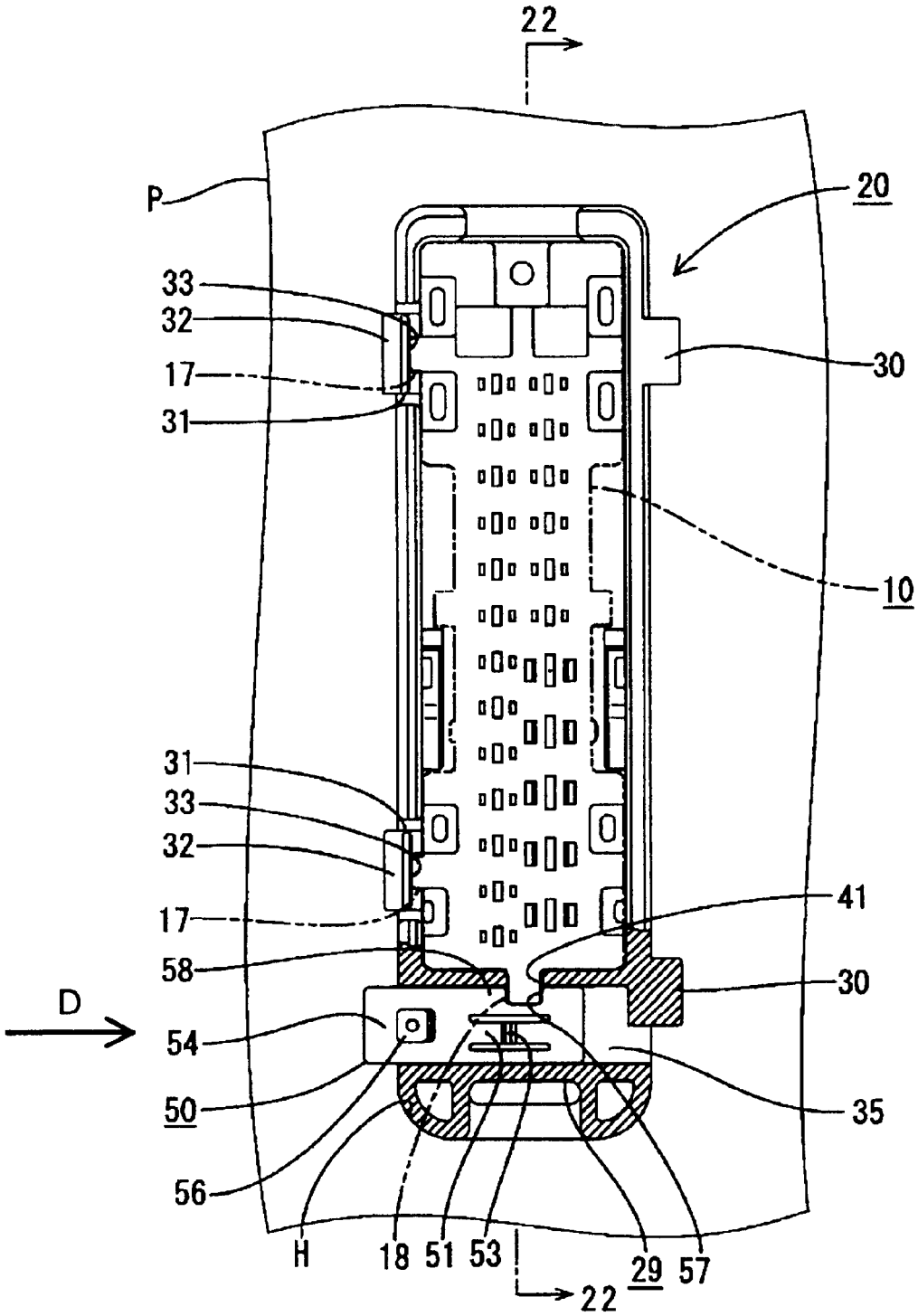
FIG. 21 is a plan view partly in section showing a relationship between the detector at the mount-detecting position and the female housing.
Figure 22:
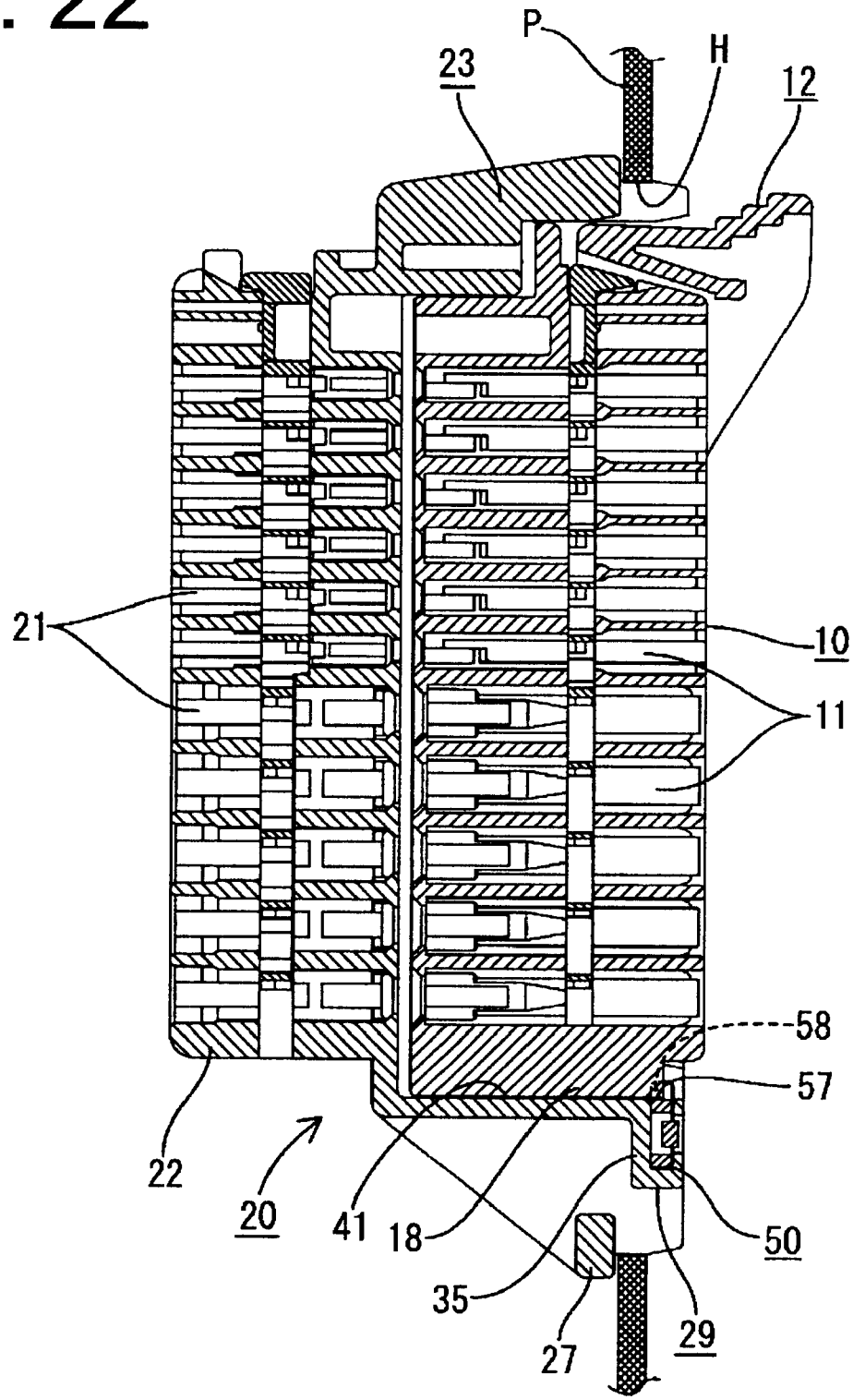
FIG. 22 is a section along 22—22 of FIG. 21.

The female housing 10 then is connected with the male housing 20 from the front side of the panel P and along the connecting direction CD, as shown in FIGS. 16 to 18. More particularly, the female housing 10 is fitted to specified depth into the receptacle 23 with the lever in the initial position, as shown in FIG. 19. The lever 12 then is rotated counterclockwise from the initial position, and the catches 25 engage the receiving portions 24, as shown in FIG. 20. As a result, the housings 10, 20 gradually connect deeper due to the lever action. The rib 18 enters the rib-receiving groove 41 and slides along the inner surface of the rib-receiving groove 41 to guide the two housings 10, 20 smoothly through the connection operation. At this stage, the detector 50 is at the mount detecting position and the rib 18 is in the insertion recess 57 of the detector 50, as shown in FIGS. 21 and 22. An attempt could be made to move the detector 50 from the mount detecting position toward the standby position during the connecting operation. However, the connection-detecting portion 58 engages the rib 18 to prevent such a movement, and to indicate that the housings 10, 20 have not yet reached a properly connected state.

Figure 23:
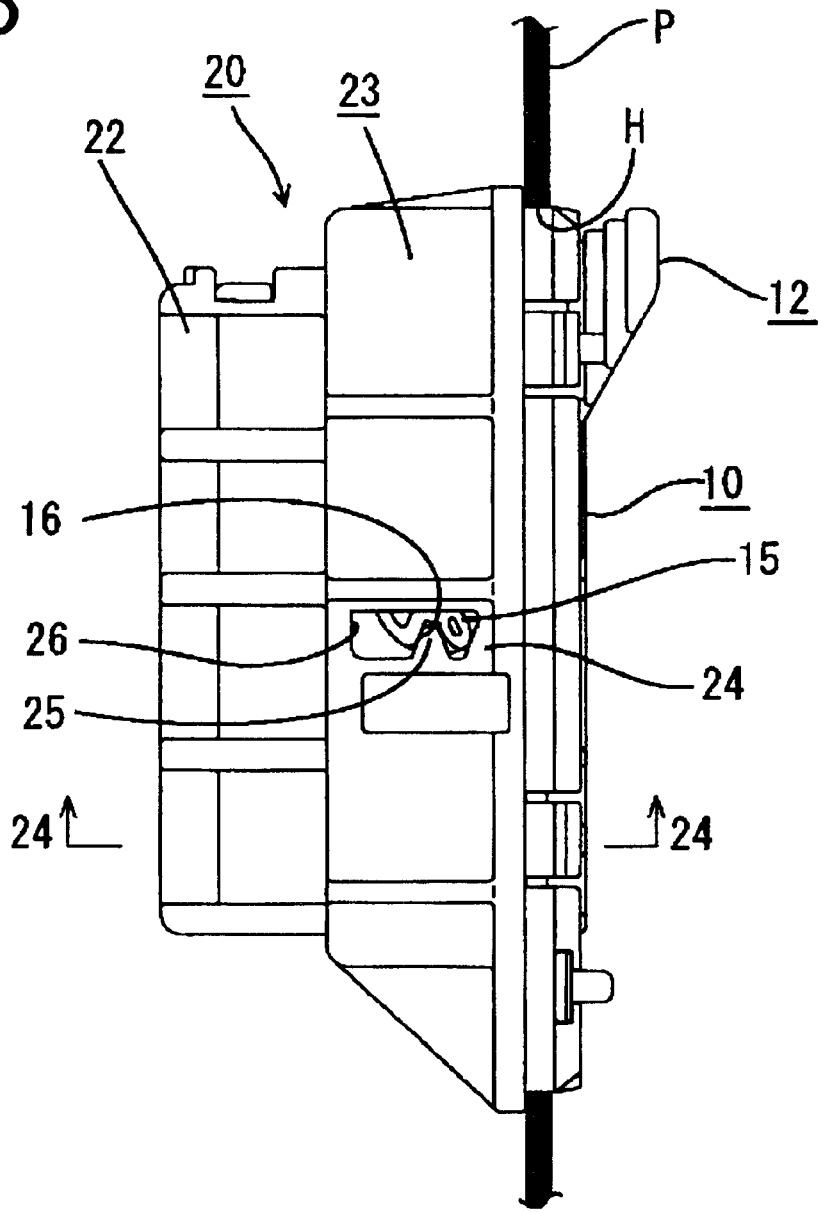
FIG. 23 is a side view showing a state reached by rotating the lever to a connection position to properly connect the male and female housings.
Figure 24:
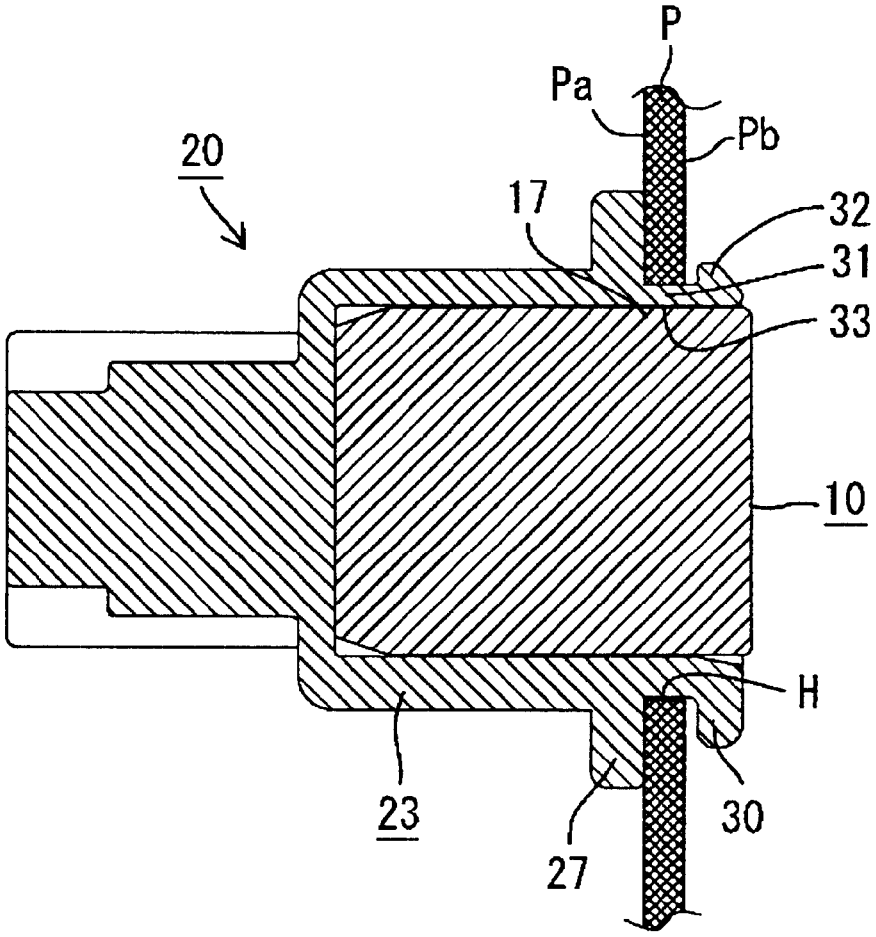
FIG. 24 is a section along 24—24 of FIG. 23.

The two housings 10, 20 are connected to proper depth when the lever 12 reaches the connection position shown in FIG. 23. Simultaneously, the projections 25 of the male housing 20 engage the recesses 16 on the lever 12 to lock the housings 10, 20 together. Additionally, the deformation preventing portions 17 of the female housing 10 enter the grooves 33 at the inner sides of the resilient locks 31, as shown in FIG. 24, to prevent deformation of the resilient locks 31. As a result, the male housing 20 is held firmly on the panel P when the two housings 10, 20 are connected properly.

Figure 25:
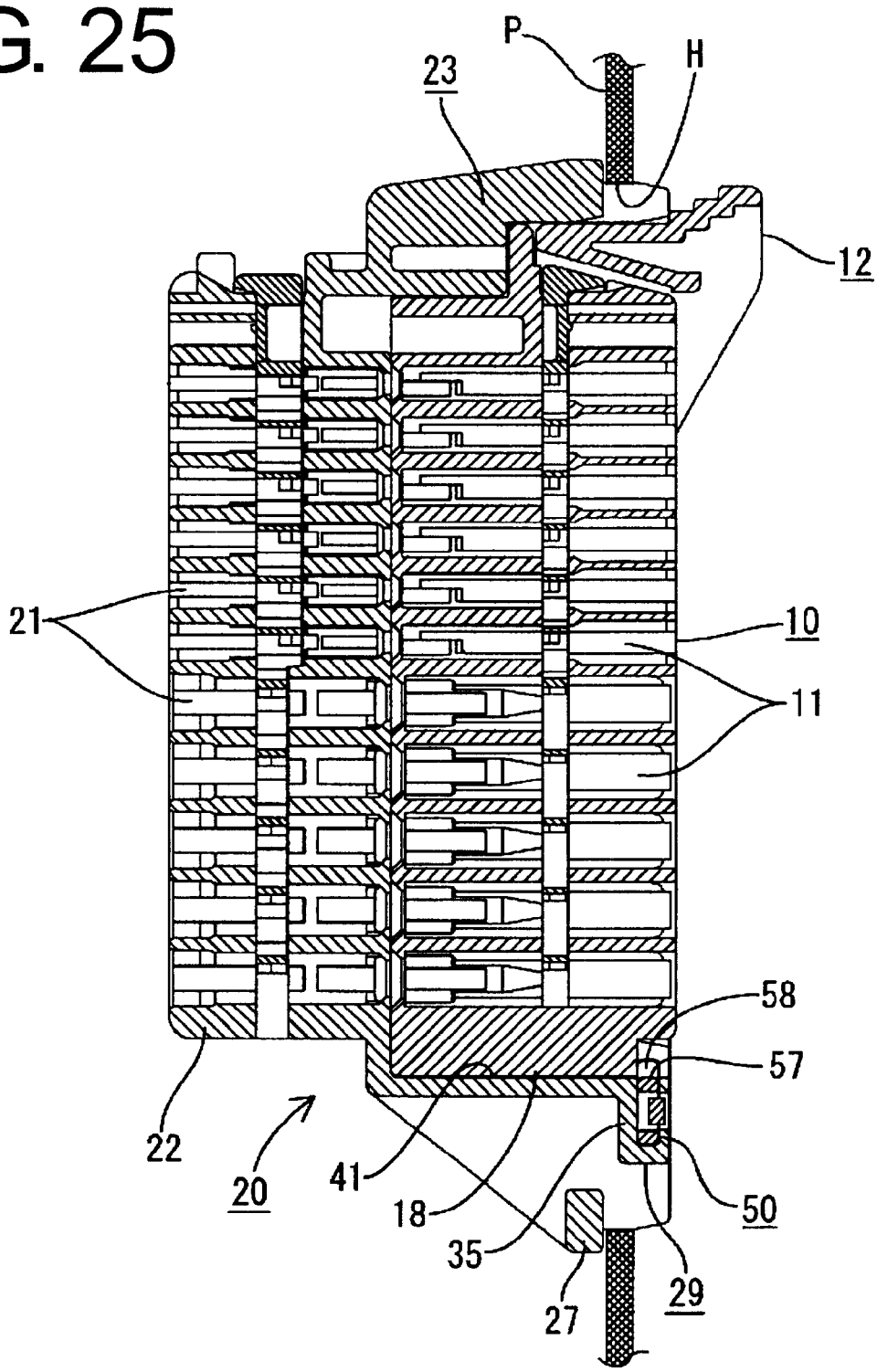
FIG. 25 is a section similar to FIG. 18, but showing a state where the male and female housings are properly connected.
Figure 26:
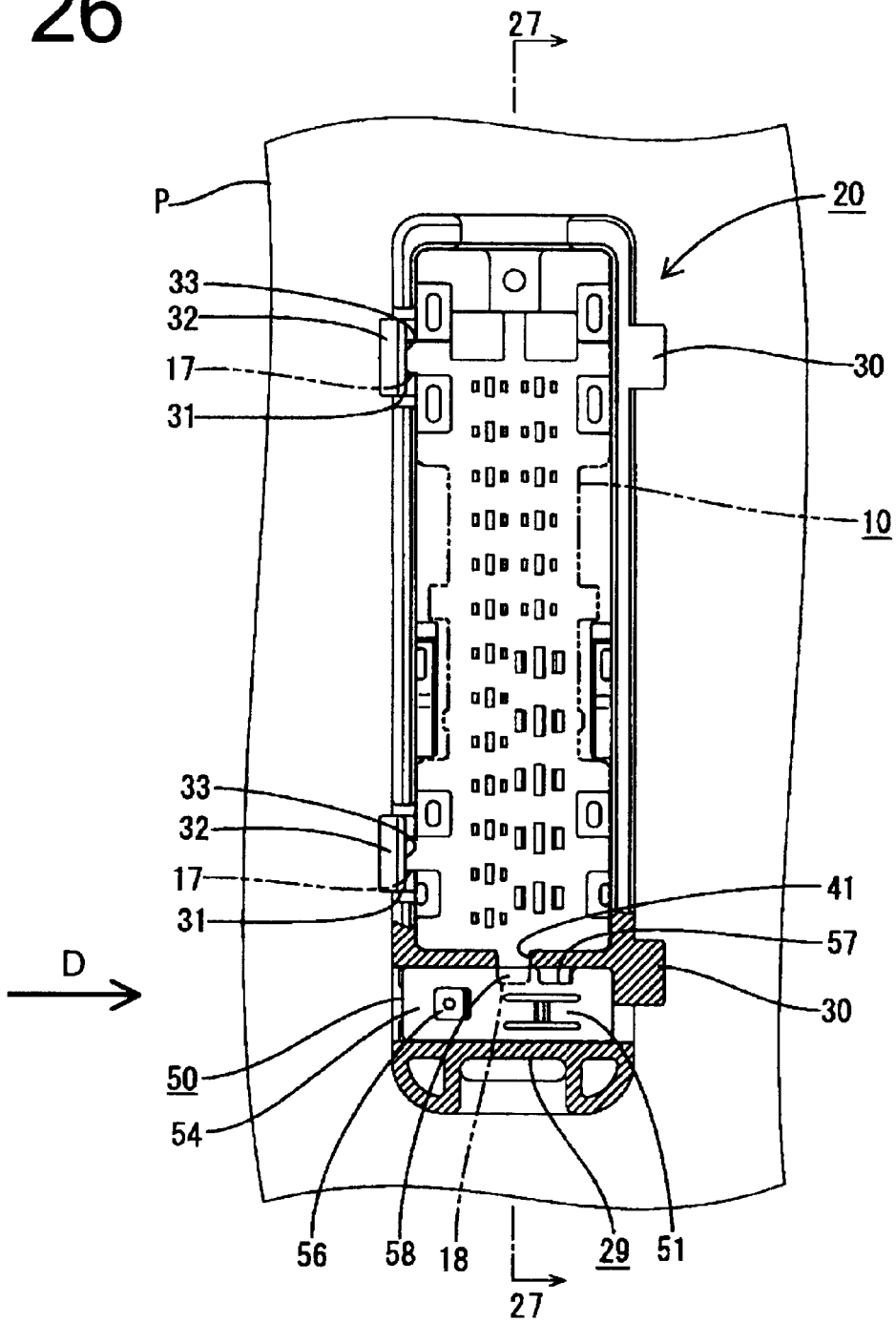
FIG. 26 is a plan view partly in section showing a state reached by moving the detector to the standby position with the male and female housings properly connected.
Figure 27:
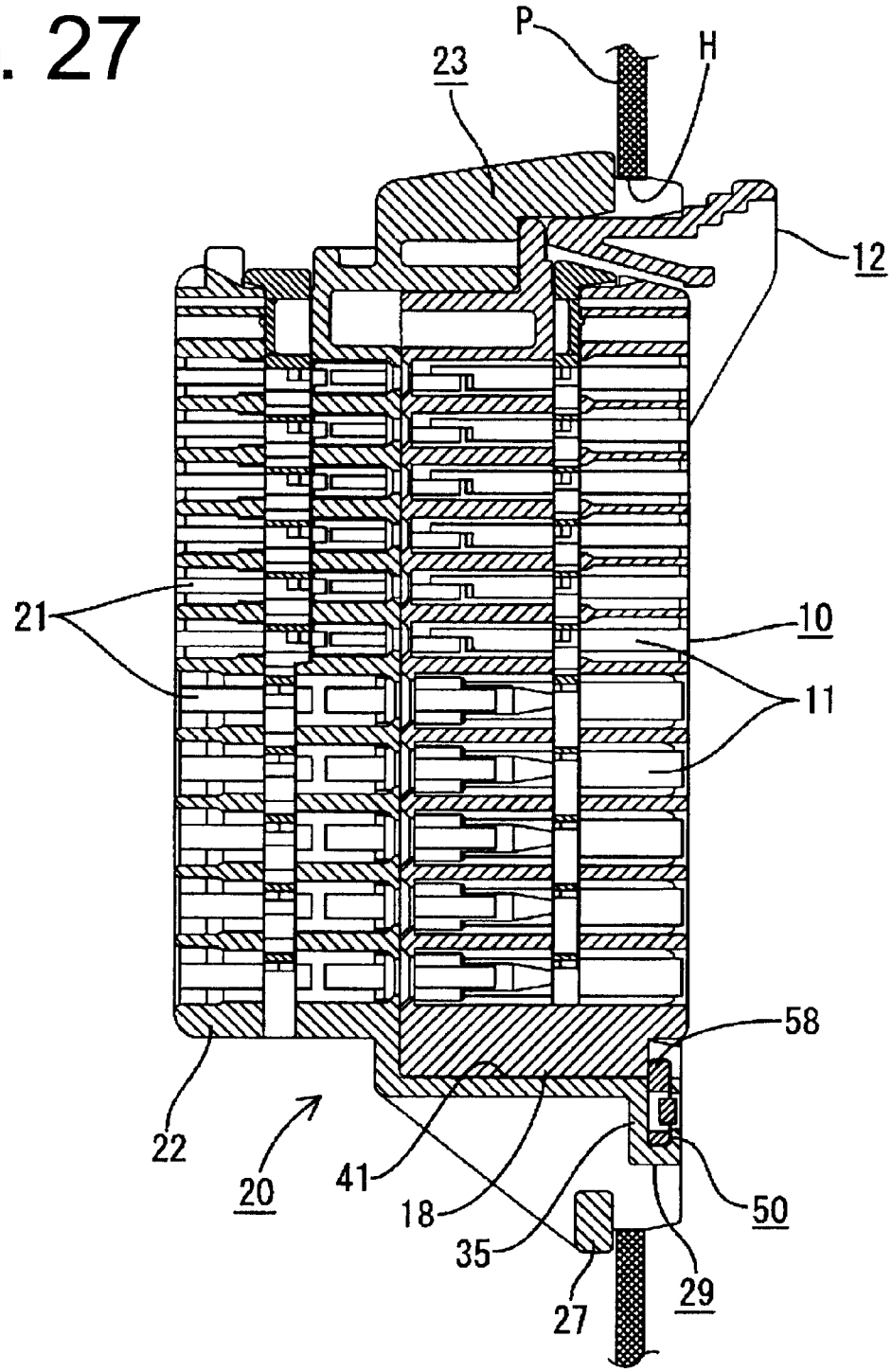
FIG. 27 is a section taken along line 27—27 of FIG. 26.

The front end surface of the rib 18 contacts the back end of the rib receiving groove 41 and the rear end surface of the rib 18 is substantially flush with the front end surface of the rear wall 35 of the detector-accommodating portion 29 when the housings 10, 20 reach the properly connected state shown in FIG. 25. Thus, the rib 18 is retracted from the detector-accommodating portion 29 and from the insertion recess 57 of the detector 50 in the detector-accommodating portion 29. Accordingly, the connection detecting portion 58 does not interfere with the rib 18 and the detector 50 can be moved from the mount detecting position to the standby position, as shown in FIGS. 26 and 27. In this way, the connected state of the housings 10, 20 can be detected based on whether the detector 50 can be moved from the mount detecting position toward the standby position after the connecting operation. The connection-detecting portion 58 is opposed to the rear end surface of the rib 18 when the detector 50 is moved to the standby position. Thus, the connection-detecting portion 58 prevents separation of the two housings 10, 20 after the detector 50 is in the standby position.

Figure 28:
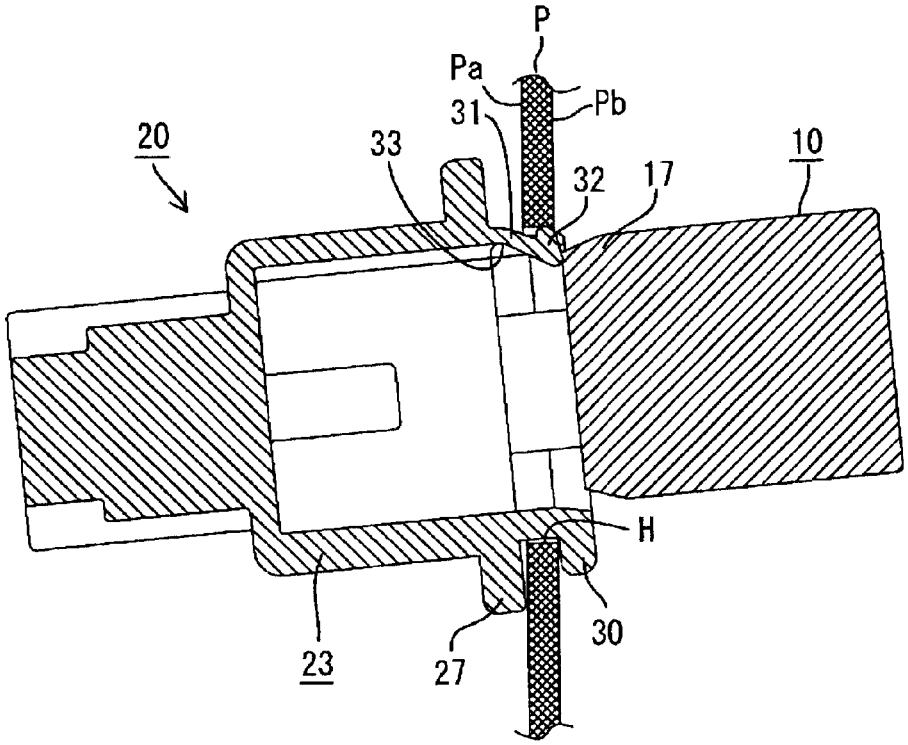
FIG. 28 is a section showing a state where a deformation-preventing portion of the female housing abuts against a deformed resilient lock.
Figure 29:
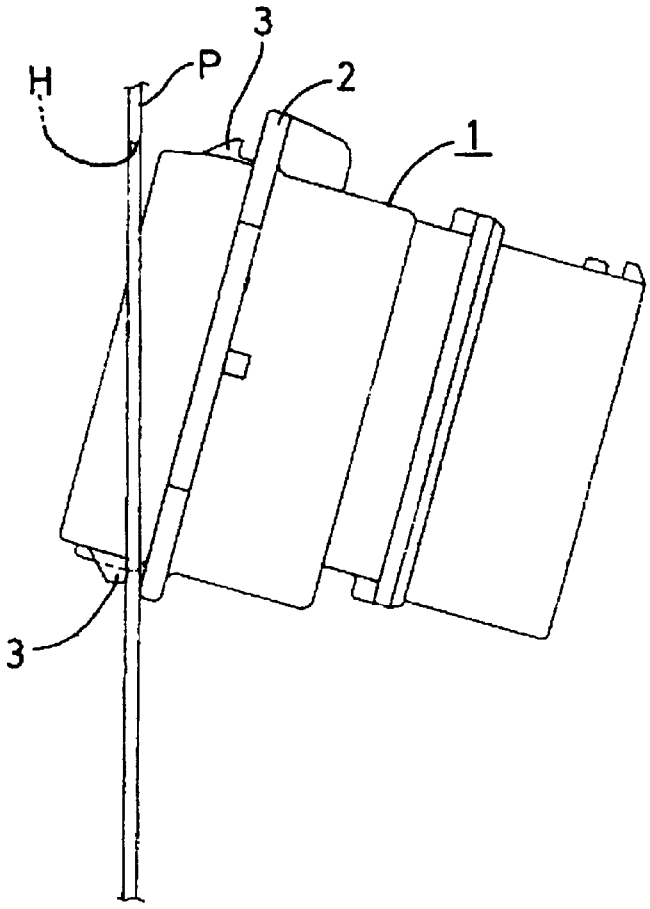
FIG. 29 PRIOR ART
FIG. 29 is a side view of a prior art connector.

The detector 50 is mounted only at one end of the longer side of the male housing 20 due to a small mounting space or other factors. Thus, the male housing 20 could be mounted on the panel P with the longer sides inclined. In this situation, the side of the male housing 20 that has the detector 50 is mounted properly to enable movement of the detector 50 to the mount detecting position. However, the opposite side of the male housing could be mounted incompletely. In other words, there is a possibility that the locking claw 32 of the resilient lock 31 closer to the detector 50 will engage the panel P while the other resilient lock 31 still is deformed. However, the deformed resilient lock 31 is in the mount hole H. Therefore, the deformation-preventing portion 17 of the female housing 10 will contact the deformed resilient lock 31, as shown in FIG. 28, to hinder further connection of two housings 10, 20. This indicates that the resilient lock 31 is left resiliently deformed and that the male housing 20 is not mounted properly on the panel P. Thus, the male housing 20 is mounted properly and the female housing 10 is connected again. In this way, the mounted state of the male housing 20 on the panel P can be detected based on whether the two housings 10, 20 can be connected with each other. Conversely, the connection of the two housings 10, 20 guarantees that the male housing 20 is mounted securely and properly on the panel P.

As described above, the mounted state of the male housing 20 on the panel P can be confirmed based on whether the detector 50 can be moved from the standby position to the mount detecting position. Similarly, the connected state of the two housings 10, 20 can be detected based on whether the detector 50 can be moved from the mount detecting position toward the standby position. This can prevent the male housing 20 from being left partly mounted on the panel P and the two housings 10, 20 from being left partly connected. In addition, the mounted state of the male housing 20 on the panel P and the connected state of the two housings 10, 20 can be detected by the single detecting member 50. Therefore, the number of parts can be reduced and the male housing 20 has a simpler construction as compared to a case where two detectors are provided for these detections.

The mounted state of the male housing 20 on the panel P and the connected state of the two housings 10, 20 are detected by reciprocating the detector 50 reciprocate between the standby position and the mount detecting position. Thus, operability can be improved and the construction of the male housing 20 can be simplified.

The connection-detecting portion 58 engages the rear end surface of the rib 18 as the detector 50 moves toward the standby position for the properly connected housings 10, 20. Thus, the connection-detecting portion 58 holds the two housings 10, 20 in the properly connected state.

An operator at the front side of the panel P may have to mount the male housing 20 from the rear side of the panel P due to limited space or other factors. However, the operator can see the operable portion 56 of the detector 50 from the front side of the panel P. This is more efficient than a situation where the operable portion is at the rear side of the panel. In this latter situation, the operable portion cannot be seen well and the state of the operation mostly depends on the feeling of the operator's fingertips. As compared to such a case, the operability of the detector 50 is improved.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The standby position and the connection-detecting position are the same in the foregoing embodiment. However, the connection-detecting position may, for example, be between the standby position and the mount-detecting position and the mount-detecting portion may be engaged with the rear surface of the panel at the connection-detecting position. Alternatively, the connection-detecting position may, for example, be set along a direction intersecting a moving direction D of the detector from the standby position to the mount-detecting position.

The detector is slightly movable from the standby position toward the mount-detecting position before the detecting portion contacts the inner surface of the mount hole H in the foregoing embodiment. However, the detecting portion may contact the inner surface of the mount hole without hardly moving the detector from the standby position by adjusting the length of the detecting portions or the like. Such an arrangement enables detection of the mounted state of the male housing based on whether the detector can be moved, thereby improving detection precision.

The inner surface of the mount hole serves also as the preventing portion for the detector in the foregoing embodiment. However, the panel may have a preventing portion separate from the mount hole. In such a case, depending on the shape and the position of this preventing portion, the detector can be at the rear side of the panel without passing through the mount hole even after the male housing is mounted on the panel. In short, the detector needs not necessarily be passed through the mount hole.

Although the operable portion of the detector projects to the front side of the panel in the foregoing embodiment, it may be provided at the rear side of the panel and operated at the rear side according to the present invention.

The male housing is mounted on the panel in the foregoing embodiment. However, the present invention also is applicable to connectors in which female housings are mounted on panels.

The detector is assembled into the male housing and the edge of the mount hole of the panel serves as the preventing portion for interfering with the detecting portion of the detector in the foregoing embodiment. However, the detector may be assembled into the panel and the male housing may have the preventing portion for interfering with the detecting portion of the detector.

The lever in the foregoing embodiment was rotated to connect the male and female connector housings. However the connection of the male and female housings may be assisted or executed by another type of movable member (e.g. a substantially linearly movable member) that may have cam means for supporting the connection of the male and female housings.

What is claimed is:

1. A connector, comprising:

a housing connectable with a mating housing after being mounted through a mount hole formed in a panel, and a detector mounted to one of the housing and the panel, including a mount-detecting portion and a connection-detecting portion and being successively movable between a standby position, a mount detecting position and a connection detecting position along a direction intersecting a connecting direction of the housings, wherein:

movement of the detector from the standby position toward the mount detecting position is prevented by interference of the mount detecting portion with one of the housing and the panel while the housing is being mounted on the panel, whereas the mount detecting portion does not interfere with either of the housing and the panel when the housing is mounted properly so that the detector is moveable to the mount detecting position, and movement of the detector from the mount detecting position toward the connection detecting position is prevented by interference of the connection detecting portion with the mating housing while the mating housing is being connected with the housing mounted on the panel, whereas the connection detecting portion does not interfere with the mating housing when the housings are connected properly and the detector is moveable to the connection detecting position.

2. The connector of claim 1, wherein the housing includes holding means for holding the housing on the panel.

3. The connector of claim 1, wherein a mounting direction of the housing on the panel is substantially parallel with the connecting direction of the housings.

4. The connector of claim 1, wherein the connection detecting position is at substantially the same position as the standby position.

5. The connector of claim 1, wherein the connection-detecting portion engages the mating housing as the detector is moved from the mount-detecting position to the connection-detecting position to lock the mating housing with the housing.

6. The connector of claim 1, wherein the housing is mountable from a rear side of the panel, and the detector includes an operable portion operable to move the detector from a front side of the panel.

7. The connector of claim 1, wherein the detector comprises an insertion recess for allowing a passage of a rib on the mating housing when the detector is at the mount detecting position.

8. The connector of claim 7, wherein the housing comprises a rib receiving groove for accommodating the rib, the rib receiving groove being aligned with the insertion recess when the detector is at the mount detecting position.

9. The connector claim 1, wherein the housing has a contact contacting a first surface of the panel and a securing portion and a resilient lock engaging a second surface of the panel.

10. The connector of claim 1, wherein the detecting portion has a guide surface for correcting the posture of the housing to a proper mounting posture by being held in sliding contact with the mount hole when an attempt is made to move the detector to the mount detecting position before the housing is mounted properly.

11. A connector for mounting to a panel at a mount hole formed in the panel, comprising:

a first housing having a penetrating portion dimensioned for insertion through the mount hole along a mounting direction;

a second housing connectable with the first housing (20); and a detector mounted to the first housing for movement successively between a standby position, a mount detecting position and a connection detecting position along a direction intersecting the mounting direction, the detector being disposed to interfere with the mount hole when the housing is being mounted on the panel and to be clear of the mount hole when the housing is mounted properly on the panel so that the detector can be moved from the standby position to the mount detecting position when the housing is mounted properly on the panel, and the detector having a connection detecting portion disposed to interfere with the second housing while the housings are being connected and to be clear of the second housing when the housings are connected properly so that the detector is moveable to the connection detecting position when the housings are connected properly.

12. The connector of claim 11, wherein the first housing includes holding means for holding the first housing on the panel.

13. The connector of claim 11, wherein the mounting direction of the first housing on the panel is substantially parallel with a connecting direction along which the housings are connected.

14. The connector of claim 11, wherein the connection detecting position is at substantially the same position as the standby position.

15. The connector of claim 11, wherein the connection-detecting portion engages the second housing as the detector is moved from the mount-detecting position to the connection-detecting position to lock the second housing with the first housing.

16. The connector of claim 11, wherein the detector comprises an insertion recess for allowing a passage of a rib on the second housing when the detector is at the mount detecting position.

17. The connector of claim 16, wherein the first housing comprises a rib receiving groove for accommodating the rib, the rib receiving groove being aligned with the insertion recess when the detector is at the mount detecting position.

* * * * *